US010702734B2

(12) United States Patent
Pompile et al.

(10) Patent No.: US 10,702,734 B2
(45) Date of Patent: Jul. 7, 2020

(54) ADJUSTABLE MULTI-POSITION STABILIZING AND STRENGTHENING APPARATUS

(71) Applicants: Domenic J. Pompile, Delray Beach, FL (US); James Grant, Sewickley, PA (US)

(72) Inventors: Domenic J. Pompile, Delray Beach, FL (US); James Grant, Sewickley, PA (US)

( * ) Notice: Subject to any disclaimer, the term of this patent is extended or adjusted under 35 U.S.C. 154(b) by 110 days.

(21) Appl. No.: 15/924,801

(22) Filed: Mar. 19, 2018

(65) Prior Publication Data

US 2018/0264312 A1 Sep. 20, 2018

Related U.S. Application Data

(60) Provisional application No. 62/472,647, filed on Mar. 17, 2017.

(51) Int. Cl.
*A63B 21/00* (2006.01)
*A63B 23/04* (2006.01)
(Continued)

(52) U.S. Cl.
CPC .... *A63B 21/4033* (2015.10); *A63B 21/00178* (2013.01); *A63B 21/0552* (2013.01);
(Continued)

(58) Field of Classification Search
CPC ..... A63B 21/4033; A63B 21/4001; A63B 21/4049; A63B 24/0062; A63B 23/16; A63B 23/14; A63B 23/1281; A63B 23/1245; A63B 23/10; A63B 23/08; A63B 23/0494; A63B 23/0482; A63B 2220/13; A63B 2220/56; A63B 2220/833; A63B 2220/803; A63B 2225/52; A63B 2225/20; A63B 2225/09; A63B 71/0686;
(Continued)

(56) References Cited

U.S. PATENT DOCUMENTS 5,163,451 A * 11/1992 Grellas ..... A61H 1/0274 128/898
5,417,643 A * 5/1995 Taylor ..... A61H 1/0274 601/24

(Continued)

*Primary Examiner* — Sundhara M Ganesan
(74) *Attorney, Agent, or Firm* — The Webb Law Firm

(57) ABSTRACT

A multi-position stabilizing and strengthening apparatus for use in exercising different target joints is provided. The apparatus includes: a height-adjustable base and a first assembly including a track mounted to a portion of the base defining a movement pattern. The apparatus also includes a second assembly slidably mounted to the track to permit motion of the second assembly relative to the first assembly according to the movement pattern along the track and a third assembly including a tray sized to receive a portion of a limb and/or joint of a patient. The third assembly is rotatably mounted to the second assembly to permit relative in-plane rotational motion of the third assembly relative to the second assembly. The apparatus also includes a brace assembly fixedly mounted to the tray to receive portions of the patient's joint and/or limb, thereby securing the patient's joint and/or limb to the third assembly.

20 Claims, 12 Drawing Sheets

(51) Int. Cl.

| | |
|---|---|
| ***A63B 23/08*** | (2006.01) |
| ***A63B 23/10*** | (2006.01) |
| ***A63B 23/12*** | (2006.01) |
| ***A63B 23/14*** | (2006.01) |
| ***A63B 23/16*** | (2006.01) |
| ***A63B 24/00*** | (2006.01) |
| ***A63B 71/06*** | (2006.01) |
| ***A63B 21/055*** | (2006.01) |

(52) U.S. Cl.
CPC ..... *A63B 21/4001* (2015.10); *A63B 21/4049* (2015.10); *A63B 23/0482* (2013.01); *A63B 23/0494* (2013.01); *A63B 23/08* (2013.01); *A63B 23/10* (2013.01); *A63B 23/1245* (2013.01); *A63B 23/1281* (2013.01); *A63B 23/14* (2013.01); *A63B 23/16* (2013.01); *A63B 24/0062* (2013.01); *A63B 71/0686* (2013.01); *A63B 2024/0012* (2013.01); *A63B 2024/0081* (2013.01); *A63B 2071/0627* (2013.01); *A63B 2220/10* (2013.01); *A63B 2220/13* (2013.01); *A63B 2220/16* (2013.01); *A63B 2220/30* (2013.01); *A63B 2220/34* (2013.01); *A63B 2220/51* (2013.01); *A63B 2220/56* (2013.01); *A63B 2220/62* (2013.01); *A63B 2220/803* (2013.01); *A63B 2220/833* (2013.01); *A63B 2225/09* (2013.01); *A63B 2225/093* (2013.01); *A63B 2225/20* (2013.01); *A63B 2225/52* (2013.01)

(58) Field of Classification Search
CPC ..... A63B 21/00178; A63B 21/0552; A63B 2024/0081; A63B 2220/62; A63B 2024/0012; A63B 2220/34; A63B 2220/30; A63B 2220/16; A63B 2220/10; A63B 2220/51; A63B 2071/0627; A63B 2225/093
See application file for complete search history.

(56) References Cited

U.S. PATENT DOCUMENTS

| | | | | |
|---|---|---|---|---|
| 6,007,500 | A * | 12/1999 | Quintinskie, Jr. ... | A61H 1/0281 601/33 |
| 9,999,561 | B2 * | 6/2018 | Nelson ..... | A61B 5/1121 |
| 10,220,234 | B2 * | 3/2019 | Marti ..... | A63B 21/00178 |
| 10,293,199 | B2 * | 5/2019 | Roh ..... | A61H 1/008 |
| 10,384,091 | B1 * | 8/2019 | Baker ..... | A63B 21/00069 |
| 2006/0040799 | A1 * | 2/2006 | Pompile ..... | A63B 21/0552 482/92 |
| 2009/0149783 | A1 * | 6/2009 | Nef ..... | A61H 1/0274 601/5 |
| 2009/0264799 | A1 * | 10/2009 | Bonutti ..... | A61H 1/0237 601/5 |
| 2010/0145238 | A1 * | 6/2010 | Stienen ..... | A63B 21/15 601/33 |
| 2010/0234776 | A1 * | 9/2010 | Borden ..... | A61H 1/0281 601/33 |
| 2010/0249673 | A1 * | 9/2010 | Nef ..... | A61H 1/0281 601/33 |
| 2011/0251533 | A1 * | 10/2011 | Han ..... | A61H 1/0274 601/33 |
| 2012/0310118 | A1 * | 12/2012 | Sarver ..... | A61B 5/4528 600/595 |
| 2012/0330198 | A1 * | 12/2012 | Patoglu ..... | B25J 9/0006 601/33 |
| 2013/0060171 | A1 * | 3/2013 | Fu ..... | A61H 1/0274 601/5 |
| 2013/0237883 | A1 * | 9/2013 | Malosio ..... | A61H 1/0274 601/33 |
| 2014/0336542 | A1 * | 11/2014 | Fu ..... | A61H 1/0281 601/5 |

* cited by examiner

ADJUSTABLE MULTI-POSITION STABILIZING AND STRENGTHENING APPARATUS

CROSS REFERENCE TO RELATED APPLICATION

This application claims priority to U.S. Provisional Patent Application No. 62/472,647, filed Mar. 17, 2017, which is incorporated by reference herein in its entirety.

BACKGROUND OF THE INVENTION

Field of the Invention

The invention relates generally to a strengthening and rehabilitation apparatus and, more particularly, to an adjustable multi-position apparatus adapted for performing rehabilitation activities and exercises for treatment of different joints.

Description of Related Art

Strengthening and rehabilitation machines have been in use for many years and have benefited many individuals. Generally, these machines serve a purpose to help patients regain strength, range of motion, and function for injured and/or surgically repaired joints. For example, a rehabilitation machine may be used for the development of the rotator cuff musculature of a user by isolating the head of the humerus in the glenoid cavity during internal and external rotation. However, a problem with conventional shoulder rehabilitation machines is that they do not stabilize the shoulder in an optimal position for strengthening the rotator cuff muscles. In particular, many existing apparatus do not allow for resisted scapular retraction, as well as adduction of the arm while fixated at 90 degrees. Such machines also may not provide for resisted shoulder internal and external rotation. Conventional devices also do not allow for scapular depression when the arm is at 90 degrees of shoulder abduction. Such devices also do not accommodate resisted internal rotation, which is usually twice as strong as that of external rotation.

For example, U.S. Pat. No. 4,817,943 discloses a rehabilitation machine that allows for strengthening the shoulder muscles. However, the machine does not allow for mobility and stabilization of the glenohumeral joint. U.S. Pat. No. 4,944,508 discloses a rehabilitation machine that holds the arm at a shallow angle of below 90 degrees. The machine must be stabilized to a solid surface, such as a table. U.S. Pat. No. 5,058,574 discloses a device for fixating the lower arm. The device does not allow for proper shoulder mechanics and stabilization of the glenohumeral joint. Further, these machines do not provide proper stabilization of the humerus and shoulder blade, while strengthening the rotator cuff with interchangeable levels of the resistances.

For these reasons, while presently known devices and apparatus may be suitable for the particular purpose to which they address, they are not suitable for individuals to be able to optimize range of motion, strength building, and stability. Presently known devices also do not allow for myofascial release techniques to decrease spasm. Further still, many presently available devices are not adapted for use with different target joints and/or may not provide sufficient support or stabilization of different joints. For these reasons, there is a need for new stabilization and rehabilitation devices capable of addressing these deficiencies.

SUMMARY OF THE INVENTION

According to an aspect of the disclosure, a multi-position stabilizing and strengthening apparatus for use in exercising different target joints is provided. The apparatus includes: a height adjustable base and a first assembly comprising a track defining a movement pattern mounted to a portion of the base. The apparatus also includes a second assembly slidably mounted to the elongated track of the first assembly to permit motion of the second assembly relative to the first assembly according to the movement pattern along the track and a third assembly including a tray sized to receive a portion of a limb and/or joint of a patient. The third assembly is rotatably mounted to the second assembly to permit relative in-plane rotational motion of the third assembly relative to the second assembly. The apparatus also includes a brace assembly fixedly mounted to the tray of the third assembly to receive portions of the patient's joint and/or limb, thereby securing the patient's joint and/or limb to the third assembly.

According to another aspect of the disclosure, a system for exercising one or more target joints is provided. The system includes a stabilizing and strengthening apparatus, at least one sensor disposed on the stabilizing and strengthening apparatus, and a controller. The stabilizing and strengthening apparatus includes: a height-adjustable base; a first assembly including an elongated track mounted to a portion of the base; a second assembly slidably mounted to the track of the first assembly to permit motion of the second assembly relative to the first assembly along the track; a third assembly including a tray sized to receive a portion of a limb and/or joint of a patient, the third assembly being rotatably mounted to the second assembly to permit relative in-plane rotational motion of the third assembly relative to the second assembly; and a brace assembly fixedly mounted to the tray of the third assembly to receive portions of the patient's joint and/or limb, thereby securing the patient's joint and/or limb to the apparatus. The at least one sensor is configured to obtain information about positioning of the assemblies of the apparatus and/or about relative motion of the assemblies of the apparatus. The controller is configured to: receive and process information from the at least one sensor; analyze the processed information to determine one or more exercise parameters, the parameters including one or more of a quality, duration, and intensity of exercises performed with the apparatus; and generate a report including the one or more exercise parameters. In some examples, exercise parameters can include a maximum or average force exerted against the apparatus by the user, a duration that force is exerted by the user, a number of exercises or actions performed by the user (e.g., a number of times that the user moves his arm, leg, foot, or other extremity back and forth, forward and backward, etc.), a maximum or average range of motion performed by the user during the exercises, a total distal traveled by a target limb or joint during the exercises, and others.

According to another aspect of the disclosure, a system for confirming that a patient completes a treatment protocol of exercises to be performed using a stabilizing and strengthening apparatus is provided. The system includes the stabilizing and strengthening apparatus, at least one sensor disposed on the apparatus, and a controller. The strengthening and stabilizing apparatus includes: a height adjustable base;

a first assembly comprising a track defining a movement pattern mounted to a portion of the base; a second assembly slidably mounted to the track of the first assembly to permit motion of the second assembly relative to the first assembly along the track; a third assembly including a tray sized to receive a portion of a limb and/or joint of a patient, the third assembly being rotatably mounted to the second assembly to permit relative in-plane rotational motion of the third assembly relative to the second assembly; and a brace assembly fixedly mounted to the tray of the third assembly to receive portions of the patient's joint and/or limb, thereby securing the patient's joint and/or limb to the apparatus. The at least one sensor is configured for obtaining information about positioning of the assemblies of the apparatus and/or about relative motion of the assemblies of the apparatus. The controller is configured to: obtain a treatment protocol for the patient using the apparatus; receive and process information from the at least one sensor as the patient performs exercises using the apparatus; analyze the processed information to identify the exercises performed by the patient; and compare the identified exercises to a treatment protocol of exercises to be performed by the patient. In some examples, the controller may also be configured to transmit the received and processed information to remote sources for data collection, review, or further analysis. In some examples, the controller may be configured to output an alert of an aspect of an exercise performed by the patient is unsatisfactory (e.g., if an exercise is unsafe, being performed incorrectly, etc.).

According to another aspect of the disclosure, a method for treating a shoulder or elbow of a patient with a multi-use stabilizing and strengthening apparatus is provided. The method includes: stabilizing the patient's forearm by connecting the forearm to an orthosis support and mounting the orthosis support to the multi-use stabilizing and strengthening apparatus. The apparatus includes: a height adjustable base; a first assembly including an elongated track mounted to a portion of the base; a second assembly slidably mounted to the elongated track of the first assembly to permit relative one-dimensional straightline motion of the second assembly relative to the first assembly along the track; and a third assembly including a tray sized to receive portions of the patient's elbow, forearm, wrist, and hand, the third assembly being rotatably mounted to the second assembly to permit relative in-plane rotational motion of the third assembly relative to the second assembly; and a brace assembly fixedly mounted to the tray and configured to receive the wrist orthosis, thereby mounting the wrist orthosis to the apparatus. The method further includes moving the second assembly back and forth along the track to cause shoulder flexion, shoulder extension, shoulder abduction, and/or shoulder adduction. Rotating the third assembly back and forth relative to the second assembly causes shoulder internal rotation and shoulder external rotation.

According to another aspect of the disclosure, a method for treating a hip and knee of a patient with a multi-use stabilizing and strengthening apparatus is provided. The method includes stabilizing the patient's thigh and knee by attaching a knee brace to the patient's leg and, with the patient in a kneeling position and with the patient's knee resting on a portion of the apparatus, mounting the knee brace to the multi-use stabilizing and strengthening apparatus. The apparatus includes: a height adjustable base; a first assembly including an elongated track mounted to a portion of the base; a second assembly slidably mounted to the elongated track of the first assembly to permit relative one-dimensional straightline motion of the second assembly relative to the first assembly along the track; a third assembly including a tray sized to receive the patient's knee and lower leg, the third assembly being rotatably mounted to the second assembly to permit relative in-plane rotational motion of the third assembly relative to the second assembly; and a brace assembly fixedly mounted to the tray of the third assembly to receive the knee brace for removably connecting the knee brace to the apparatus. The method further includes moving the second assembly back and forth along the track to cause flexion and extension of the hip and knee and rotating the third assembly back and forth relative to the second assembly to cause internal rotation and external rotation of the knee and/or internal rotation, external rotation, abduction, and adduction of the hip.

According to another aspect of the disclosure, another example of a multi-position stabilizing and strengthening apparatus for use in exercising different target joints is provided. The apparatus includes: a height adjustable base; a first assembly having an elongated track mounted to a portion of the base; a second assembly slidably mounted to the elongated track of the first assembly to permit relative one-dimensional straightline motion of the second assembly relative to the first assembly along the track; a third assembly including a tray sized to receive a portion of a limb and/or joint of a patient, the third assembly being rotatably mounted to the second assembly to permit relative in-plane rotational motion of the third assembly relative to the second assembly; and a removable handle mounted to a distal end of the tray of the third assembly and configured to be grasped by the patient when performing shoulder and/or elbow exercises.

According to another aspect of the disclosure, a multi-position stabilizing and strengthening apparatus for use in exercising different target joints is provided. The apparatus includes a moveable assembly including a tray sized to receive a portion of a limb and/or joint of a patient, the tray being configured to actively or passively guide at least one of one-dimensional straightline motion of the limb and/or joint and in-plane rotational motion of the limb and/or joint; a brace assembly configured to receive portions of the patient's joint and/or limb; and at least one fastener for fixedly mounting the brace assembly to the tray.

Preferred and non-limiting aspects or embodiments of the present invention will now be described in the following numbered clauses:

Clause 1: A multi-position stabilizing and strengthening apparatus for use in exercising different target joints, the apparatus comprising: a height adjustable base; a first assembly comprising a track defining a movement pattern mounted to a portion of the base; a second assembly slidably mounted to the track of the first assembly to permit motion of the second assembly relative to the first assembly according to the movement pattern along the track; a third assembly comprising a tray sized to receive a portion of a limb and/or joint of a patient, the third assembly being rotatably mounted to the second assembly to permit relative in-plane rotational motion of the third assembly relative to the second assembly; and a brace assembly fixedly mounted to the tray of the third assembly to receive portions of the patient's joint and/or limb, thereby securing the patient's joint and/or limb to the third assembly.

Clause 2: The apparatus of clause 1, further comprising a removable handle mounted to a distal end of the tray of the third assembly and configured to be grasped by the patient when performing shoulder and/or elbow exercises.

Clause 3: The apparatus of clause 2, wherein the removable handle is configured to be removed from the tray of the third assembly to permit the patient to perform exercises of a hand, wrist, hip, knee, foot, and/or ankle.

Clause 4: The apparatus of any of clauses 1-3, further comprising one or more movable stops disposed within the track of the first assembly for limiting the motion of the second assembly relative to the first assembly.

Clause 5: The apparatus of any of clauses 1-4, further comprising a coupling lock between the second assembly and the third assembly, wherein the coupling lock is configured to receive one or more pins for limiting a range of rotation of the third assembly relative to the second assembly.

Clause 6: The apparatus of any of clauses 1-5, wherein the tray is an elongated molded structure comprising a proximal end mounted to the second assembly, a distal end opposite the proximal end, and a substantially flat surface extending therebetween.

Clause 7: The apparatus of clause 6, wherein the tray further comprises a cradle at the distal end thereof and shaped to receive a portion of a joint of the patient and a longitudinally extending slot positioned at the proximal end thereof.

Clause 8: The apparatus of clause 7, further comprising one or more fasteners partially disposed within the slot for removably and fixedly mounting the brace assembly to the tray of the third assembly.

Clause 9: The apparatus of any of clauses 6-8, wherein the tray comprises a single-piece molded plastic structure.

Clause 10: The apparatus of any of clauses 1-9, wherein the brace assembly comprises a brace body sized to receive and support the patient's limb, one or more straps for holding the patient's limb against the brace body, and one or more fasteners for removably mounting the brace assembly to the tray of the third assembly.

Clause 11: The apparatus of any of clauses 1-10, wherein the brace assembly comprises one or more of a hand support, a wrist support, a forearm support, a thigh support, a knee support, an ankle support, and a foot support removably mounted to the third assembly.

Clause 12: The apparatus of any of clauses 1-11, wherein the brace assembly is configured to permit a support worn by the patient to be connected thereto while performing exercises and to be removed from the brace assembly when the exercises are completed.

Clause 13: The apparatus of any of clauses 1-12, wherein the base assembly comprises a telescoping base for adjusting a vertical height of the first, second, and third assemblies.

Clause 14: The apparatus of any of clauses 1-13, further comprising one or more resistive members for resisting movement of one or more of the assemblies relative to another assembly.

Clause 15: The apparatus of clause 14, wherein the one or more resistive members comprise a resilient band having a force ranging from about 10 lbs. to about 75 lbs.

Clause 16: The apparatus of any of clauses 1-15, further comprising a resistive member mounted between the second assembly and the first assembly for biasing the second assembly to a natural position substantially in a center of the track of the first assembly.

Clause 17: The apparatus of any of clauses 1-16, wherein the respective assemblies are configured to move relative to one another to provide passive movement for one or more target joints.

Clause 18: The apparatus of any of clauses 1-17, wherein the respective assemblies are configured to move relative to one another to provide active movement for one or more target joints.

Clause 19: The apparatus of any of clauses 1-18, further comprising a motion wand pivotally mounted to a distal end of the third assembly, the motion wand being configured to be grasped by a user or by the patient to control range of motion of exercises performed using the apparatus and to provide for active movement of one or more target joints.

Clause 20: A system for exercising one or more target joints comprising: a stabilizing and strengthening apparatus comprising: a height-adjustable base; a first assembly comprising an elongated track mounted to a portion of the base; a second assembly slidably mounted to the elongated track of the first assembly to permit relative one-dimensional straightline motion of the second assembly relative to the first assembly along the track; a third assembly comprising a tray sized to receive a portion of a limb and/or joint of a patient, the third assembly being rotatably mounted to the second assembly to permit relative in-plane rotational motion of the third assembly relative to the second assembly; and a brace assembly fixedly mounted to the tray of the third assembly to receive portions of the patient's joint and/or limb, thereby securing the patient's joint and/or limb to the apparatus; at least one sensor disposed on the stabilizing and strengthening apparatus for obtaining information about positioning of the assemblies of the apparatus and/or about relative motion of the assemblies of the apparatus; and a controller configured to: receive and process information from the at least one sensor; analyze the processed information to determine one or more exercise parameters, the parameters comprising one or more of a quality, duration, and intensity of exercises performed with the apparatus; and generate a report including the one or more exercise parameters.

Clause 21: The system of clause 20, further comprising transmitting the report to a remote device for review by a physician, physical therapist, or caregiver.

Clause 22: The system of clause 20 or clause 21, wherein the controller is further configured to compare the one or more exercise parameters to one or more threshold values and to provide a notification to the patient when the parameters exceed the threshold values.

Clause 23: The system of clause 22, wherein the threshold values are based on a treatment protocol for the patient.

Clause 24: The system of any of clauses 20-23, wherein the at least one sensor comprises one or more position sensors configured to obtain information representative of a range of straightline and/or rotational motion permitted by the apparatus.

Clause 25: The system of any of clauses 20-24, wherein the at least one sensor comprises one or more pressure sensors disposed on portions of the third assembly and/or brace assembly, the one or more pressure sensors being configured to be contacted by a limb of the patient to measure a pressure exerted against the apparatus by the patient.

Clause 26: The system of any of clauses 20-25, wherein the at least one sensor comprises one or more velocity sensors configured to obtain information representative of speed of straightline and/or rotational movement of the respective assemblies during performance of the one or more exercises.

Clause 27: A system for confirming that a patient completes a treatment protocol of exercises to be performing using stabilizing and strengthening apparatus, the system comprising: the stabilizing and strengthening apparatus, comprising: a height adjustable base; a first assembly comprising an elongated track mounted to a portion of the base; a second assembly slidably mounted to the elongated track of the first assembly to permit relative one-dimensional straightline motion of the second assembly relative to the first assembly along the track; a third assembly comprising a tray sized to receive a portion of a limb and/or joint of a patient, the third assembly being rotatably mounted to the second assembly to permit relative in-plane rotational motion of the third assembly relative to the second assembly; and a brace assembly fixedly mounted to the tray of the third assembly to receive portions of the patient's joint and/or limb, thereby securing the patient's joint and/or limb to the apparatus; at least one sensor disposed on the stabilizing and strengthening apparatus for obtaining information about positioning of the assemblies of the apparatus and/or about relative motion of the assemblies of the apparatus; and a controller configured to: obtain a treatment protocol of exercises to be performed by the patient; receive and process information from the at least one sensor as the patient performs exercises using the apparatus; analyze the processed information to identify the exercises performed by the patient; and compare the identified exercises to the treatment protocol.

Clause 28: The system of clause 27, wherein the controller is further configured to provide a notification to the patient when all exercises of the treatment protocol have been completed.

Clause 29: The system of clause 27 or clause 28, wherein the controller is configured to transmit a confirmation that the treatment protocol has been completed to a remote device.

Clause 30: A method for treating a shoulder or elbow of a patient with a multi-use stabilizing and strengthening apparatus, the method comprising: stabilizing the patient's forearm by connecting the forearm to an orthosis support; mounting the orthosis support to the multi-use stabilizing and strengthening apparatus, wherein the apparatus comprises: a height adjustable base; a first assembly comprising an elongated track mounted to a portion of the base; a second assembly slidably mounted to the elongated track of the first assembly to permit relative one-dimensional straightline motion of the second assembly relative to the first assembly along the track; a third assembly comprising a tray sized to receive portions of the patient's elbow, forearm, wrist, and hand, the third assembly being rotatably mounted to the second assembly to permit relative in-plane rotational motion of the third assembly relative to the second assembly; and a brace assembly fixedly mounted to the tray and configured to receive the orthosis support, thereby mounting the orthosis support to the apparatus; moving the second assembly back and forth along the track to cause shoulder flexion, extension, abduction, and/or adduction; and rotating the third assembly back and forth relative to the second assembly to cause shoulder internal rotation and shoulder external rotation.

Clause 31: The method of clause 30, wherein movement of the respective assemblies occurs simultaneously.

Clause 32: The method of clause 30 or clause 31, further comprising adjusting an elevation of the track by pivoting the first assembly relative to the base.

Clause 33: The method of any of clauses 30-32, wherein the orthosis support comprises a partially tubular body formed from a rigid material and one or more straps for holding the patient's forearm against the partially tubular body.

Clause 34: The method of any of clauses 30-33, further comprising grasping a handle extending from the tray of the third assembly during movement of the assemblies.

Clause 35: The method of any of clauses 30-34, wherein movement of the respective assemblies is passive movement guided by a range of motion wand affixed to the third assembly.

Clause 36: The method of any of clauses 30-35, wherein movement of the respective assemblies is active movement caused by extension, flexion, and/or rotation of the patient's shoulder.

Clause 37: The method of any of clauses 30-36, wherein the apparatus comprises one or more resilient bands positioned to resist the straightline and/or rotational movement of the respective assemblies, thereby strengthening the patient's shoulder during performance of the exercises.

Clause 38: A method for treating a hip and knee of a patient with a multi-use stabilizing and strengthening apparatus, the method comprising: stabilizing the patient's thigh and knee by attaching a knee brace to the patient's leg; with the patient in a kneeling position and with the patient's knee resting on a portion of the apparatus, mounting the knee brace to the multi-use stabilizing and strengthening apparatus, wherein the apparatus comprises: a height adjustable base; a first assembly comprising an elongated track mounted to a portion of the base; a second assembly slidably mounted to the elongated track of the first assembly to permit relative one-dimensional straightline motion of the second assembly relative to the first assembly along the track; a third assembly comprising a tray sized to receive the patient's knee and lower leg, the third assembly being rotatably mounted to the second assembly to permit relative in-plane rotational motion of the third assembly relative to the second assembly; and a brace assembly fixedly mounted to the tray of the third assembly to receive the knee brace for removably connecting the knee brace to the apparatus; moving the second assembly back and forth along the track to cause flexion and extension of the hip and knee; and rotating the third assembly back and forth relative to the second assembly to cause internal rotation and external rotation of the knee.

Clause 39: The method of clause 38, wherein movement of the respective assemblies occurs simultaneously.

Clause 40: The method of clause 38 or clause 39, further comprising adjusting an elevation of the track by pivoting the first assembly relative to the base.

Clause 41: The method of any of clauses 38-40, wherein movement of the respective assemblies is passive movement guided by a range of motion wand affixed to the third assembly.

Clause 42: The method of any of clauses 38-41, wherein movement of the respective assemblies is active movement caused by extension and flexion, rotation, abduction and/or adduction of the patient's hip and/or knee.

Clause 43: The method of any of clauses 38-42, wherein the apparatus comprises one or more resilient bands positioned to resist the straightline and/or rotational movement of the respective assemblies, thereby strengthening the patient's hip and knee during performance of the exercises.

Clause 44: A multi-position stabilizing and strengthening apparatus for use in exercising different target joints, the apparatus comprising: a height adjustable base; a first assembly comprising an elongated track mounted to a portion of the base; a second assembly slidably mounted to the elongated track of the first assembly to permit relative one-dimensional straightline motion of the second assembly relative to the first assembly along the track; a third assembly comprising a tray sized to receive a portion of a limb and/or joint of a patient, the third assembly being rotatably mounted to the second assembly to permit relative in-plane rotational motion of the third assembly relative to the second assembly; and a removable handle mounted to a distal end of the tray of the third assembly and configured to be grasped by the patient when performing shoulder and/or elbow exercises.

Clause 45: The apparatus of clause 44, wherein the removable handle is configured to be removed from the tray of the third assembly to permit the patient to perform exercises of a hand, wrist, hip, knee, foot, and/or ankle.

Clause 46: The apparatus of clause 44 or clause 45, further comprising one or more movable stops disposed within the track of the first assembly for limiting the relative one-dimensional straightline motion of the second assembly relative to the first assembly.

Clause 47: The apparatus of any of clauses 44-46, further comprising a coupling lock between the second assembly and the third assembly, wherein the coupling lock is configured to receive one or more pins for limiting a range of rotation of the third assembly relative to the second assembly.

Clause 48: The apparatus of any of clauses 44-47, wherein the tray is an elongated molded structure comprising a proximal end mounted to the second assembly, a distal end opposite the proximal end, and a substantially flat surface extending therebetween.

Clause 49: The apparatus of clause 48, wherein the tray further comprises a cradle at the distal end thereof and shaped to receive a portion of a joint of the patient.

Clause 50: The apparatus of clause 49, wherein the cradle comprises a knee cup sized to receive a knee of the patient.

Clause 51: The apparatus of any of clauses 48-50, wherein the tray comprises a single-piece molded plastic structure.

Clause 52: The apparatus of any of clauses 44-52, wherein the base assembly comprises a telescoping base for adjusting a vertical height of the first, second, and third assemblies.

Clause 53: The apparatus of any of clauses 44-52, further comprising one or more resistive members for resisting movement of one or more of the assemblies relative to another assembly.

Clause 54: The apparatus of clause 53, wherein the one or more resistive members comprise a resilient band having a force ranging from about 10 lbs. to about 75 lbs.

Clause 55: The apparatus of any of clauses 44-54, further comprising a resistive member mounted between the second assembly and the first assembly for biasing the second assembly to a natural position substantially in a center of the track of the first assembly.

Clause 56: The apparatus of any of clauses 44-55, wherein the respective assemblies are configured to move relative to one another to provide passive movement for one or more target joints.

Clause 57: The apparatus of any of clauses 44-56, wherein the respective assemblies are configured to move relative to one another to provide active movement for one or more target joints.

Clause 58: The apparatus of any of clauses 44-57, further comprising a motion wand pivotally mounted to a distal end of the third assembly, the motion wand being configured to be grasped by a user or by the patient to control range of motion of exercises performed using the apparatus and to provide for active movement of one or more target joints.

Clause 59: A multi-position stabilizing and strengthening apparatus for use in exercising different target joints, the apparatus comprising: a moveable assembly comprising a tray sized to receive a portion of a limb and/or joint of a patient, the tray being configured to actively or passively guide at least one of one-dimensional straightline motion of the limb and/or joint and in-plane rotational motion of the limb and/or joint; a brace assembly configured to receive portions of the patient's joint and/or limb; and at least one fastener for fixedly mounting the brace assembly to the tray.

Clause 60: The apparatus of clause 59, wherein the tray further comprises a cradle at the distal end thereof shaped to receive a portion of a joint of the patient.

Clause 61: The apparatus of clause 59 or clause 60, wherein the tray further comprises a longitudinally extending slot positioned at the proximal end thereof configured to receive a portion of the at least one fastener.

Clause 62: The apparatus of clause 61, wherein the brace assembly comprises at least one hole configured to receive the at least one fastener for mounting the brace assembly to the tray.

Clause 63: The apparatus of any of clauses 59-62, wherein the at least one fastener comprises one or more of a bolt, a screw, a pin, a post, and a rod.

BRIEF DESCRIPTION OF THE DRAWINGS

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limit of the invention.

DETAILED DESCRIPTION

Figure 1:
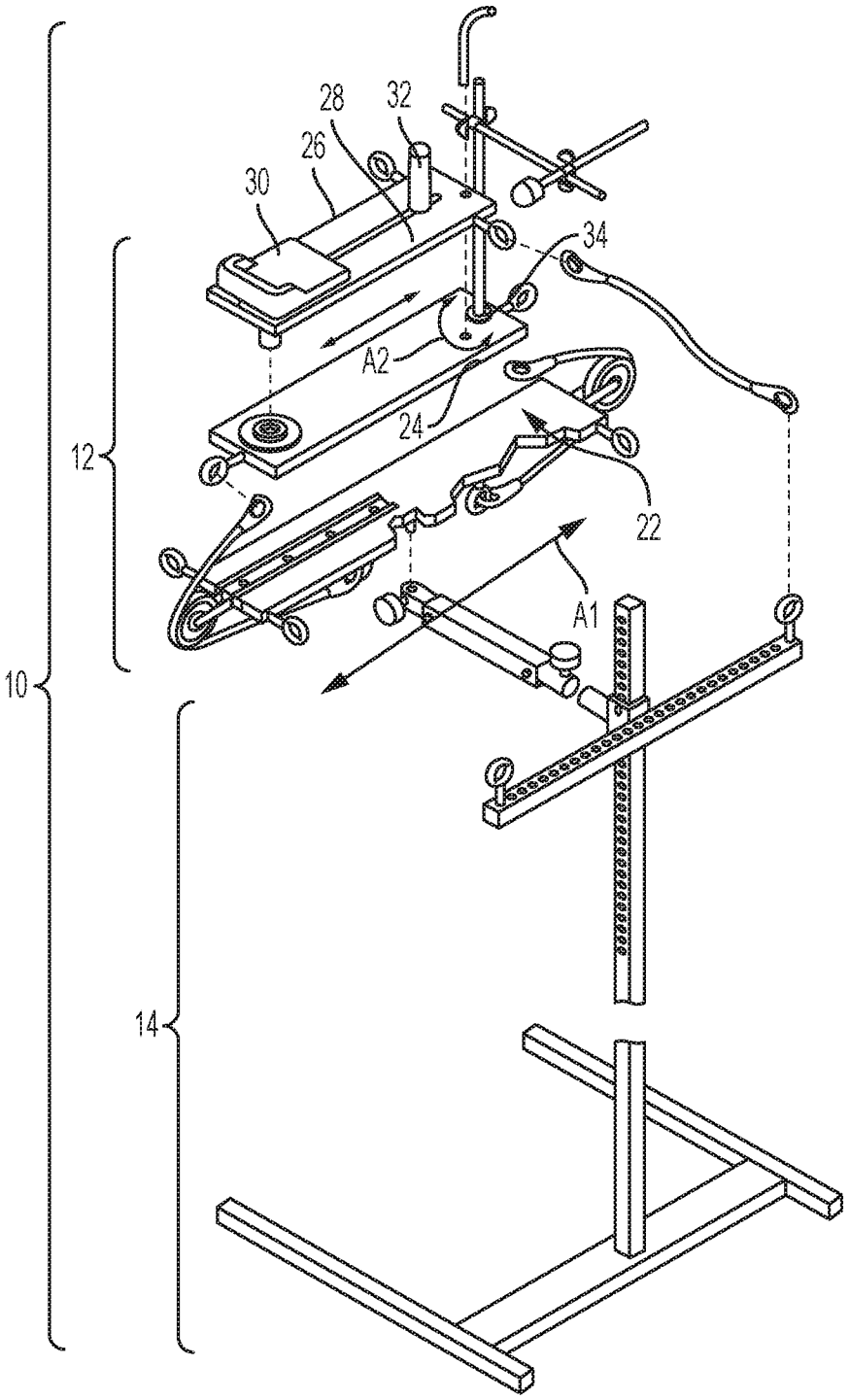
FIG. 1 PRIOR ART
FIG. 1 is a perspective view of a prior art shoulder stabilizing and strengthening apparatus.

As used herein, the singular form of "a", "an", and "the" include plural referents unless the context clearly dictates otherwise. For the purposes of this specification, unless otherwise indicated, all numbers expressing quantities of ingredients, reaction conditions, dimensions, physical characteristics, and so forth used in the specification and claims are to be understood as being modified in all instances by the term "about."

As used herein, the terms "right", "left", "top", and derivatives thereof shall relate to the invention as it is oriented in the drawing figures. However, it is to be understood that the invention can assume various alternative orientations and, accordingly, such terms are not to be considered as limiting. Also, it is to be understood that the invention can assume various alternative variations and stage sequences, except where expressly specified to the contrary. It is also to be understood that the specific devices and processes illustrated in the attached drawings, and described in the following specification, are examples. Hence, specific dimensions and other physical characteristics related to the embodiments disclosed herein are not to be considered as limiting.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or transmit data to the other unit or component. This can refer to a direct or indirect connection that can be wired and/or wireless in nature. Additionally, two units or components can be in communication with each other even though the data transmitted can be modified, processed, routed, and the like between the first and second unit or component. For example, a first unit can be in communication with a second unit even though the first unit passively receives data and does not actively transmit data to the second unit. As another example, a first unit can be in communication with a second unit if an intermediary unit processes data from one unit and transmits processed data to the second unit. It will be appreciated that numerous other arrangements are possible.

Shoulder Stabilizing and Strengthening Apparatus

A shoulder stabilizing and strengthening apparatus 10 configured to support a variety of stabilized shoulder strengthening exercises is illustrated in FIG. 1. To perform movements or exercises using the apparatus 10, a patient rests his/her arm and elbow on a movable component of the apparatus 10, referred to herein as a third stage or assembly 26 of the apparatus 10. The third assembly 26 is moveable relative to other portions of the apparatus 10 and, in particular, is configured to rotate and slide relative to other portions of the apparatus 10 to support the patient's arm, elbow, and shoulder as exercises and movements are performed. In this way, the apparatus 10 continues to provide support for the arm, elbow, and shoulder throughout exercises and movement. As described in detail herein, in some instances, the apparatus 10 can include resilient or biasing structures, such as flexible bands, which counteract movement of the third assembly 26 relative to other portions of the apparatus 10. The patient improves strength of target joints and muscles by performing exercises and movements with sufficient force to overcome the biasing force or resiliency of the flexible bands. An exemplary shoulder stabilizing and strengthening apparatus 10, which can be configured to perform these exercises and movements, is described in U.S. Pat. No. 7,621,857, which is incorporated by reference herein in its entirety.

More specifically, as shown in FIG. 1, the shoulder stabilizing and strengthening apparatus 10 includes a multi-piece or multi-stage motion portion 12 which supports the arm, wrist, and shoulder during exercises or movement thereof. The motion portion 12 can be mounted to a base assembly 14. The base assembly 14 is configured to support the apparatus 10 on a horizontal surface (e.g., a floor or table). In other examples, the base assembly 14 may be sized and shaped to be mounted to a vertical surface (e.g., a wall). The motion portion of the apparatus 10 has a stacked arrangement including a first assembly 22, a second assembly 24, and the third assembly 26 mounted together to permit the patient to move his/her arm and shoulder in multiple directions and/or planes. During use, the patient's arm rests against a top surface 28 of the third assembly 26. For example, the top surface 28 of the third assembly can include a cradle 30 for receiving the patient's elbow and/or forearm. The third assembly 26 can also include a handle 32 opposite the cradle 30 for the patient to grasp during use.

Optionally, the first assembly 22 is pivotally mounted to the base assembly 14, such that the elevation or pitch of the motion portion 12 can be adjusted. Adjusting the angle between the base assembly 14 and the first assembly 22 adjusts direction of movement permitted by the apparatus 10. The first assembly 22 is connected to the second assembly 24, such that the second assembly 24 slides along the first assembly 22, thereby permitting motion in a linear direction as indicated by arrow A1. The second assembly 24 is rotatably mounted to the third assembly 26 at a pivot point (e.g., a coupling 34), such that the third assembly 26 rotates freely relative to the first assembly and the second assembly 24 at the coupling 34. The direction of rotation is shown by arrow A2 in FIG. 1.

In use, the patient places his/her elbow in the cradle 30 and grasps the handle 32. For some exercises, the patient presses his/her hand against the handle 32 to cause rotation of the third assembly 26 about the coupling 34. For other exercises, the patient extends and retracts his/her shoulder thereby causing the second and third assemblies 24, 26 to slide relative to the first assembly 22 in the direction of arrow A1. Movement of the third assembly 26 in the direction of arrow A1 is also used for performing shoulder abduction and shoulder adduction motions.

The apparatus 10 discussed herein is used for stabilizing the shoulder during performance of various strengthening exercises and, generally, is not used with other joints. Further, the apparatus 10 does not include sensors or electronic circuitry for tracking use of the device, progress of the patient, or other data. Further, the apparatus 10 is not adapted for use with other stabilization and support structures or components, such as braces, orthosis, slings, splints, and the like.

Adjustable Multi-Use Stabilizing and Strengthening Apparatus

A modified rehabilitation apparatus is disclosed herein, which addresses and improves upon the shoulder apparatus 10 shown in FIG. 1. For example, an improved stabilizing and strengthening apparatus 110 for addressing these issues is illustrated in FIGS. 2A to 13. The apparatus 110 disclosed herein can be used for rehabilitative purposes, strengthening, and exercising injured joints and limbs. According to an aspect of the disclosure, the apparatus 110 is configured to allow for optimal passive range of motion, active assistive range of motion, and active unassistive range of motion for an affected or target joint. Desirably, the apparatus 110 is used with an effective rehabilitation, stabilization, and strengthening program for a specific target joint to improve healing and overall patient outcomes. In particular, the apparatus 110 can be adjusted to be used throughout the continuum of care from providing stabilization for a post-operative joint, to addressing conditions affecting a non-operative joint, to returning a target or surgically repaired joint to normal function.

In some examples, the apparatus 110 can be adjusted or repositioned to permit rehabilitation of multiple joints including but not limited to the shoulder, elbow, hand, wrist, hip, knee, ankle, and foot. The apparatus is configured to be positioned so that these joints can be directed through various movements or exercises in a variety of planes and/or directions. This adjustability allows the patient to complete motions of each joint, such as flexion, extension, abduction, adduction, internal rotation, external rotation, ulnar and radial deviation, supination and pronation. For the ankle joint, motions of plantar flexion, dorsiflexion, inversion, and eversion can also be performed. Desirably, adjustments needed for preparing the apparatus 110 to perform different exercises and/or to treat different joints is relatively minor and can be performed by a patient in, for example, a home setting.

As a result of the configurations described herein, the apparatus 110 provides for optimal mechanics of the effected joint, thereby allowing the affected or target joint to function in an intended manner. Further, the apparatus 110 provides for movement of the joint in multiple directions simultaneously, sequentially, or according to another movement pattern or protocol. For example, the apparatus 110 can be configured to allow for proper coupling of the joint to maximize rotation thereof, thereby creating an optimal foundation in which a ball and socket joint (e.g., a shoulder or hip) freely rotates as it is mechanically designed to do. In some examples, the apparatus 110 is adapted for use in myofascial and self-myofascial release techniques, such as for the glute medius, quadrates lumborum, pectoral minor, levator scapulae, rhomboids, trapezius, illiotibial band, rectus femoris, and quadriceps movements.

In some examples, the apparatus 110 includes a brace sling, strap, orthosis, rigid support, flexible support, or mechanical stabilizing device for stabilizing and supporting the impaired joint during use of the rehabilitation apparatus 110. In this way, the apparatus 110 can be used for post-operative patients instructed to wear a brace or support at all times, so that the patient can effectively and safely perform a highly effective rehabilitation program while maintaining the joint in a safe position and at his/her current functional capacity. Desirably, the apparatus 110 can be adapted to accommodate different types and sizes of braces for the hand, wrist, elbow, shoulder, hip, lumbar spine, knee, ankle, and foot. In some examples, the apparatus 110 is configured to allow the patient to easily engage, attach, connect, mount, and/or clip the brace on to the apparatus to use the apparatus without needing to remove the brace. After an exercise or treatment protocol is completed, the patient can easily clip out of the apparatus 110 without taking off his/her brace, thereby ensuring that the target joint or limb is properly supported continuously. In other examples, the brace can be connected to the patient and rest against the apparatus 110 without being mechanically or directly connected to the apparatus 110. In other examples, a patient may wear a brace, such as an orthosis or splint, to support a limb. The brace and supported limb can be inserted into a second brace assembly mounted to the apparatus 110 to provide additional support for the limb as exercises are being performed. Once the exercises are completed, the patient can disengage the brace from the second brace assembly, but continue wearing the brace. In this way, the limb is supported continually both before and following the exercise activities.

In some examples, the apparatus 110 includes structures, such as resistance bands or weights, for counteracting the patient's motion to improve strength. In other examples, the apparatus 110 can be configured for passive movement of a target joint. For example, the apparatus 110 can include a movement wand or bar, which can be used by the patient or by a physical therapist or caregiver, to passively move (e.g., extend, retract, or rotate) the target joint.

In some examples, the apparatus 110 is configured to provide strengthening and stabilization for the target joint in an efficacious manner, while stabilizing surrounding structures. By stabilizing and, in some instances, restricting movement of surrounding structures, compensatory motions from unwanted muscles and/or joints is controlled or reduced. Controlling or reducing motions from such compensatory muscles is believed to help maximize outcomes by ensuring that the target joint receives maximum impact of the movements and exercises. For example, in some instances, the apparatus 110 can be configured to limit the patient's range of motion in certain directions with a range of motion stops and guides, which can be tailored to particular joint specific protocols.

According to another aspect of the disclosure, a strengthening and rehabilitating apparatus 110 can include one or more sensors for measuring movement range, force, and other parameters as a patient uses the apparatus 110. For example, the apparatus 110 can include force sensors for measuring an amount of force exerted by the patient against the apparatus 110 as exercises are being performed. Such force and resistance measurements can be representative of the patient's strength. Increase in force or resistance over time indicates that the patient is becoming stronger, that muscles are healing, and/or that certain exercises are having a desired therapeutic effect. Other sensors may be configured to measure parameters including passive range of motion, active assistive range of motion, and active range of motion. In some examples, force sensors can be replaced with or supplemented by sensors configured to measure or track a position of certain resistance structures of the apparatus 110. For example, as discussed in detail hereinafter, the apparatus 110 can include resistance band(s) 160 configured to resist active movements by the patient to increase the patient's strength. Sensors may be configured to track changes in position of the resistance band(s) 160 to document, for example, how fast the patient is able to displace the band(s)

160 and/or displacement distance of the band(s) 160. Measured displacement values can be used to calculate force exerted by the patient.

Information collected by the sensors may be stored on computer readable memory associated with the apparatus 110 or sensors. Information collected by the sensors may also be transmitted via a wired or wireless communications components to a remote source or device for data collection and review. For example, information from the one or more sensors can be relayed to the remote device(s) and made available to other users or third parties via a web portal, a smart phone or tablet application, website, computer network, or similar electronically accessible system or device. In some instances, transmitted data may be used by a telemedicine service to review and document at-home use of the apparatus 110 by a patient to confirm that an at-home patient is performing exercises in an instructed manner and to document improvements in a patient's condition following use of the apparatus 110 over time. In some examples, the telemedicine service may automatically or manually prepare patient reports documenting the patient's compliance with and performance of exercise protocols. Patient reports can be made available to the patient's physician or physical therapist either electronically (via email or a secured website) or as a hard copy sent through the mail.

With reference to FIGS. 2A, 2B, 3A, and 3B, according to a preferred and non-limiting embodiment of the present invention, the adjustable multi-position or multi-stage stabilizing and strengthening apparatus 110 is illustrated. As in previously-described exemplary devices, the apparatus 110 is configured for enabling and supporting movement of a target joint in multi-directions or planes of motion. The apparatus 110 can include multiple stages, pieces, or assemblies, each of which is configured or designed to permit or guide movement of the joint and/or limb in one plane or direction. For example, a first stage or assembly of the apparatus 110 may enable movement of the joint in a back and forth direction (e.g., abduction and adduction). A second piece or stage of the apparatus may enable rotation of the joint about a fixed point to effectuate internal and/or external rotation of a target joint. Other pieces or stages of the apparatus may support the target joint to prevent unwanted movement in another plane or direction (e.g., to prevent undesirable twisting or rotation of the joint in certain directions) or to limit certain compensatory movements of adjacent muscles or joints as described herein. In some instances, a stage or piece may be a single element, such as a rigid structure formed from molded plastic and shaped to support a patient's arm or leg. In other examples, a piece or stage of the apparatus 110 may include multiple elements including support structures, straps, clamps, pins, fasteners, flexible connectors, resistive or biasing members, and the like to achieve its particular purpose. For clarity, each stage or piece of the apparatus 110 is generally referred to herein as an assembly. It is understood that each assembly may comprise one or more pieces or elements which collectively enable its particular function. The multiple assemblies are connected together, as described herein, in a stacked arrangement to form the apparatus 110.

In some preferred and non-limiting embodiments, the apparatus 110 includes a base assembly 114 having a pedestal 118 and a telescoping base 116 mounted thereto. As will be appreciated by one of ordinary skill in the art, a telescoping base 116 is a height adjustable structure comprising an inner member slidably received within an outer member. Sliding the inner member away from the outer member increases the length of the telescoping base 116. Sliding the inner member into the outer member decreases the length of the telescoping base 116. Generally, the pedestal 118 is sized and shaped for placement on a floor. In other examples, the pedestal 118 may be placed on a raised surface, such as a table, stool, shelf, desk, counter, or similar supporting structure. In other examples, the pedestal 118 may be replaced with a support or mounting structure for anchoring the base assembly 114 to a vertical surface, such as a wall.

Figure 2A:
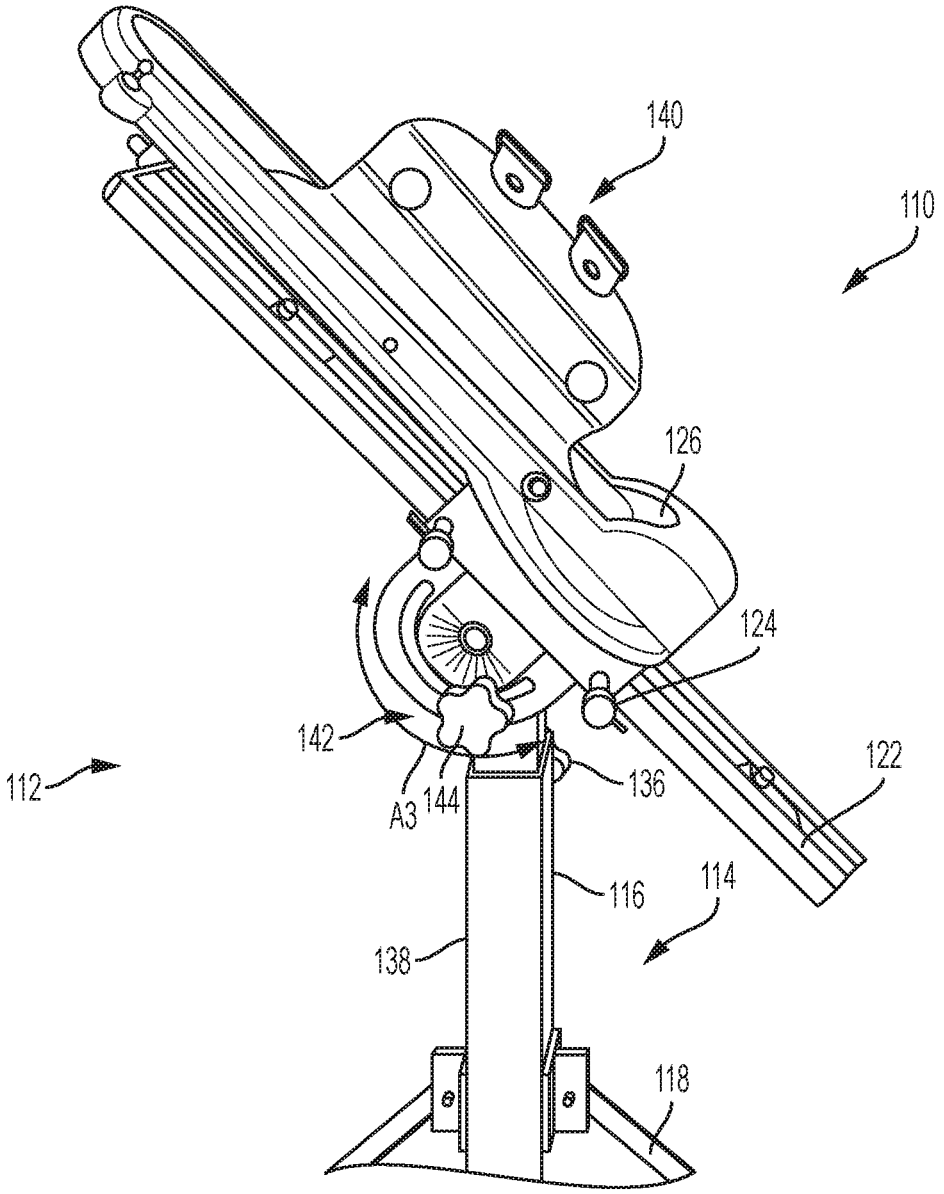
FIG. 2A is a perspective view of a multi-use stabilizing and strengthening apparatus, according to an aspect of the present disclosure.
Figure 2B:
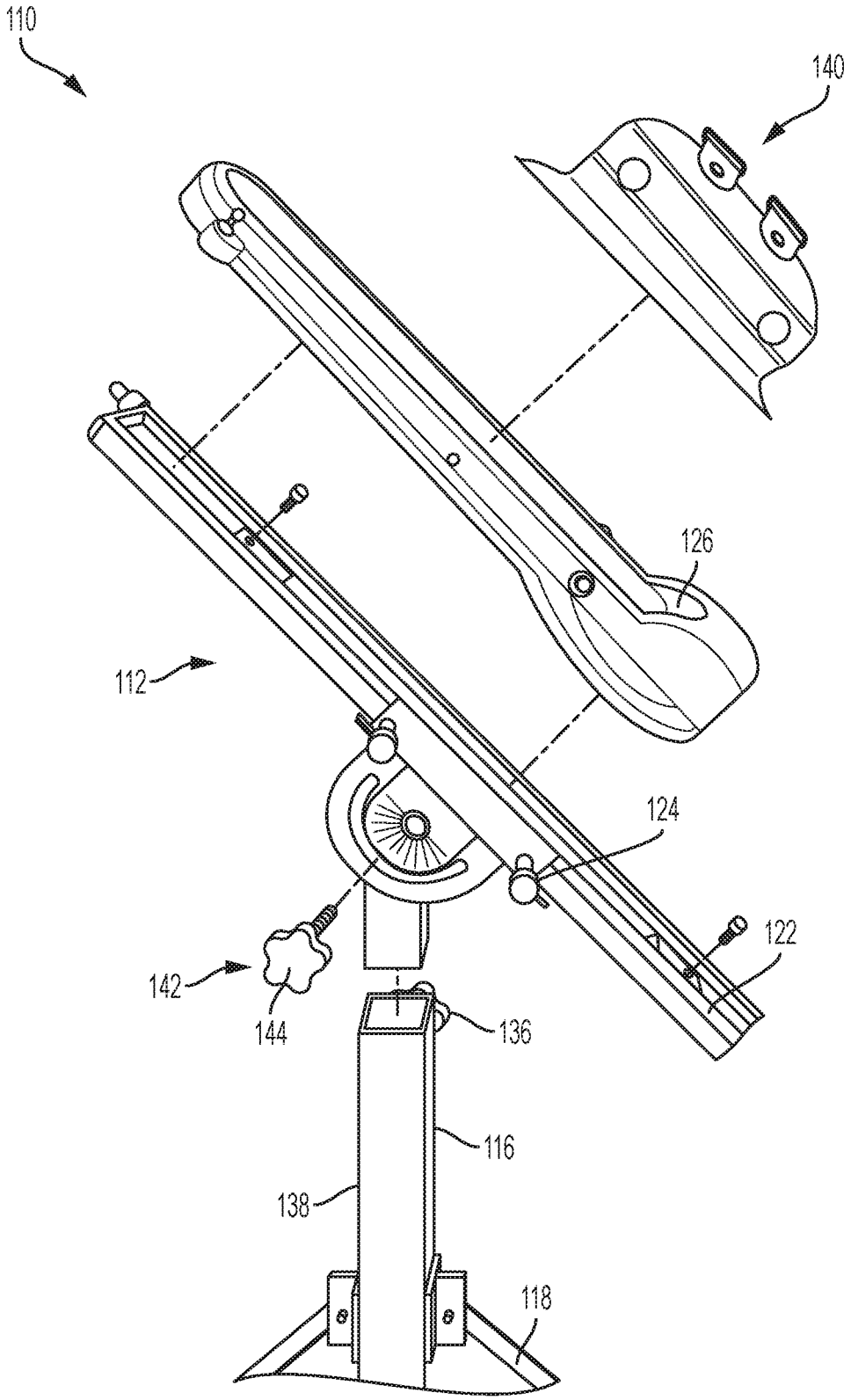
FIG. 2B is an exploded perspective view of the multi-use stabilizing and strengthening apparatus of FIG. 2A.

A motion portion 112 of the apparatus is pivotally mounted to the telescoping base 116. As in previously-discussed examples, the motion portion 112 includes a number of assemblies mounted together, which permits a patient to perform exercises by actively or passively extending and retracting a target joint through movement in multiple planes and/or directions. For example, the motion portion 112 of the apparatus 110 can include a first assembly 122, a second assembly 124, and a third assembly 126. As shown in FIGS. 2A and 2B, the first assembly 122 can be pivotally mounted to the telescoping base 116 of the base assembly 114 to permit a user to adjust the pitch or angle of the motion portion of the apparatus 110 in the direction shown by the arrow A3 in FIG. 2A. The second assembly 124 can be slidably mounted to the first assembly 122. The third assembly 126 is rotatably mounted to the second assembly 124. The motion portion 112 of the apparatus may also include a brace holder or brace assembly 140 removably or permanently mounted to the third assembly 126 as discussed in greater detail herein. In use, as described in detail herein, a patient places an arm, leg, foot, or other body part in an appropriately sized brace, splint, sling, orthosis, or support. The brace or other support is then mounted to a receiving portion of the brace assembly 140. In some instances, the patient actively moves a joint (e.g., a shoulder, knee, hip, or ankle) in directions permitted by the apparatus 110 to perform various exercises. Such active movements are supported by the apparatus to encourage or direct movements in accordance with predetermined patient protocols and to prevent overextension or injury to the target joint. In some instances, the apparatus 110 may include structures for resisting such active movement to increase strength. In other examples, the patient's movement can be passive and guided by, for example, a motion wand pushed by a therapist or by the patient's uninjured arm.

Base Assembly of the Apparatus

Figure 3A:
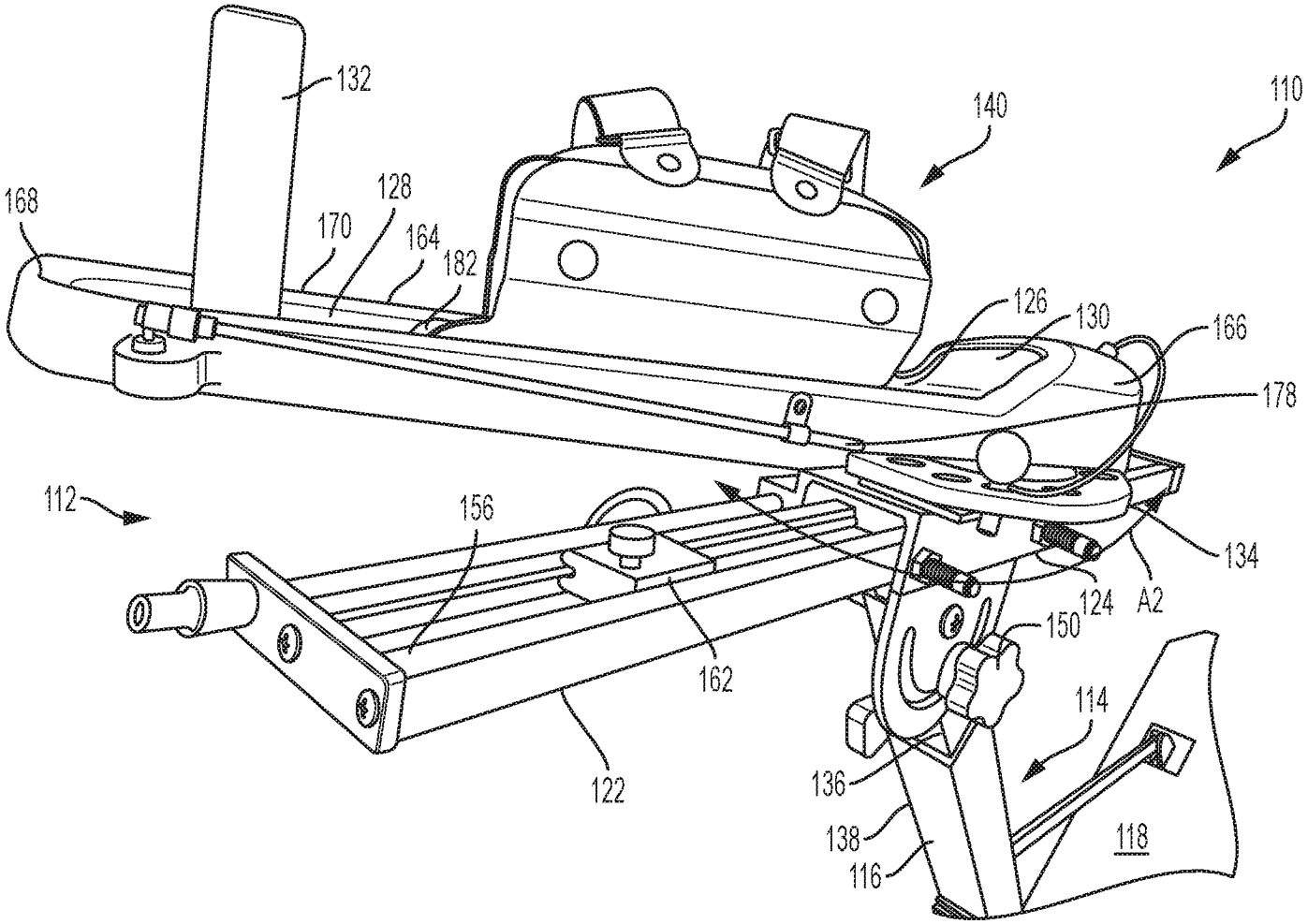
FIG. 3A is a perspective view of a movable portion of the stabilizing and strengthening apparatus of FIG. 2A.
Figure 3B:
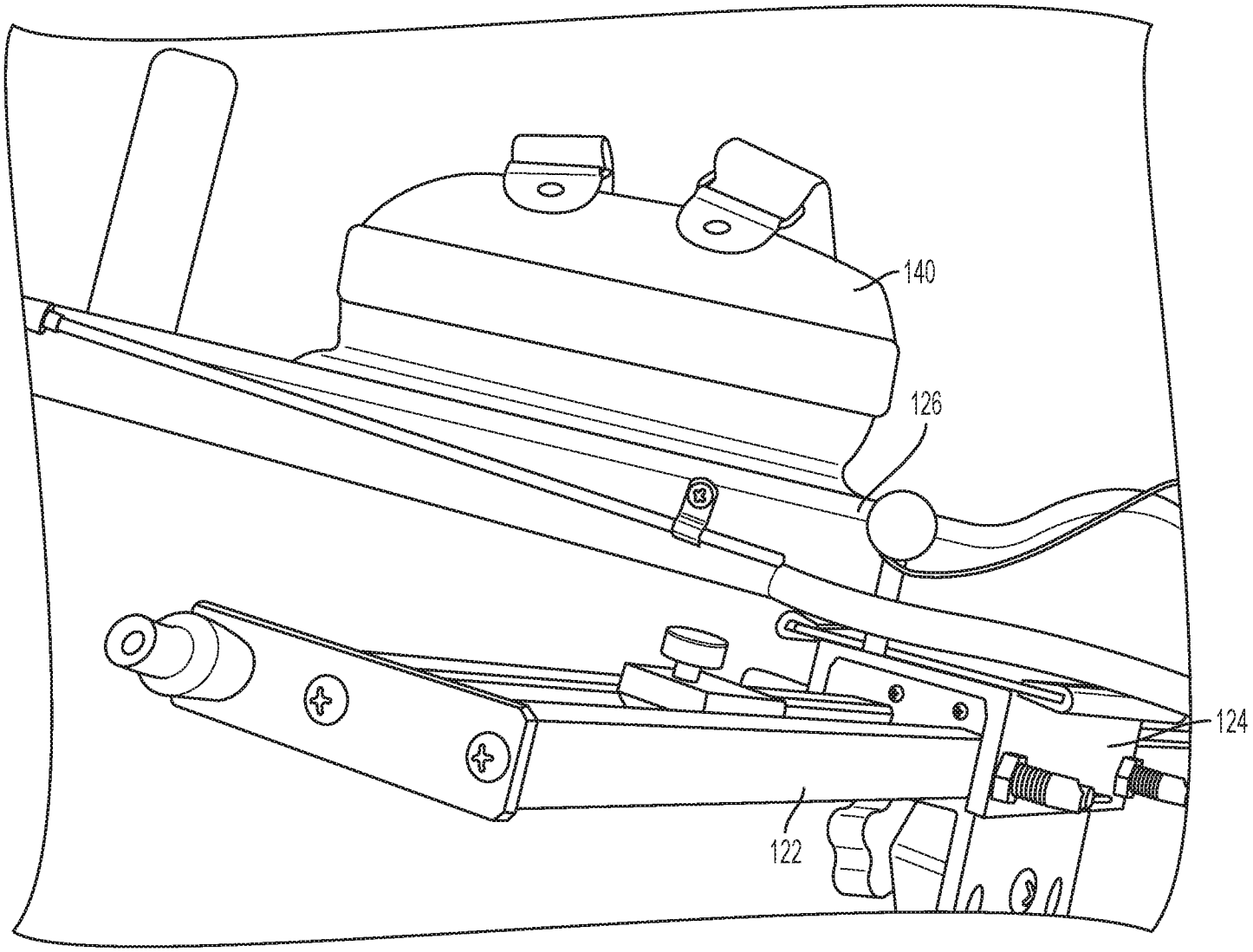
FIG. 3B is another perspective view of the movable portion of the stabilizing and strengthening apparatus of FIG. 2A.
Figure 4:
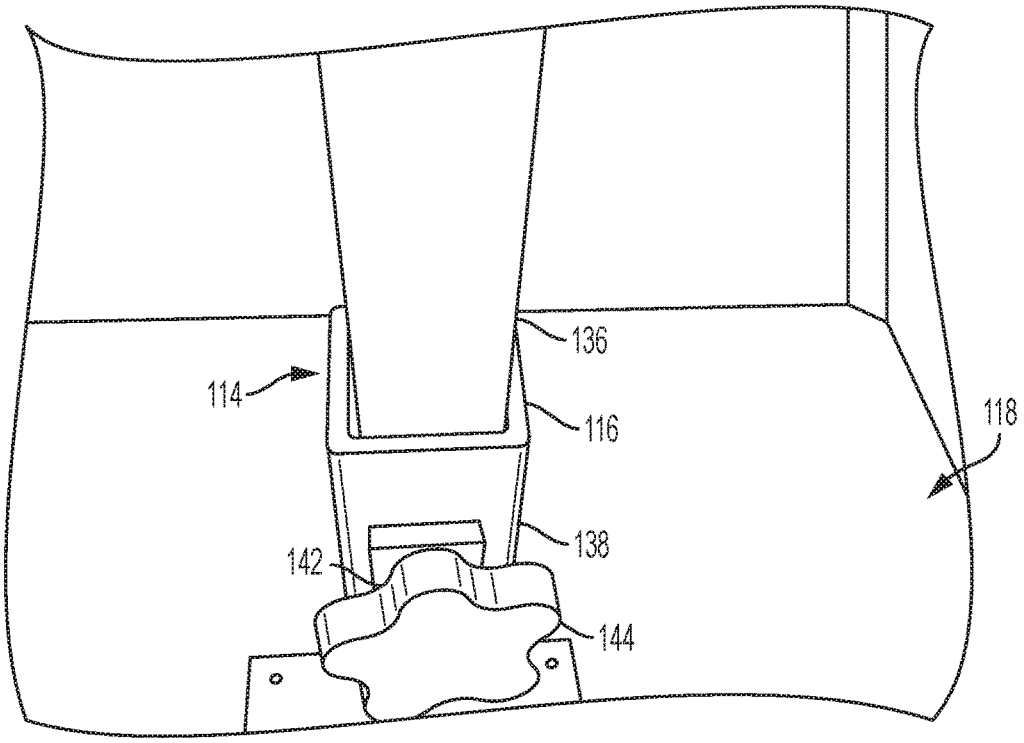
FIG. 4 is a perspective view of a base assembly of the stabilizing and strengthening apparatus of FIG. 2A.

With reference to FIGS. 2A, 2B, and 4, in some preferred and non-limiting embodiments, the base assembly 114 includes the substantially horizontal platform or pedestal 118 and the telescoping base 116 mounted thereto. The size and construction of the platform or pedestal 118 is generally chosen based on whether the apparatus 110 is intended to be portable (e.g., for temporary in-home use) or to remain permanently in one location, as would be useful in a physical therapy clinic. For portable embodiments of the apparatus 110, as shown in FIGS. 2-13, the platform or pedestal 118 is desirably formed from a rigid, but lightweight material such as plastic. The pedestal 118 is a substantially square or rectangle shape and is generally large enough to provide a solid and stable base for the apparatus 110, which prevents the apparatus from tipping over. In some examples, a patient may stand or kneel on the pedestal 118 to provide additional support for the apparatus 110 during use. For more robust, permanent embodiments of the apparatus 110, a more rigid metal frame structure may be used. A more rigid frame structure may be especially useful for larger or heavier embodiments of the apparatus 110, such as embodiments which include weights or additional biasing structures for increasing the patient's muscle strength, as would be used with, for example, rehabilitating for professional or amateur athletes. In some examples, a more permanent version of the apparatus 110 may be mounted to a wall or counter for added support.

The telescoping base 116 is mounted to the platform or pedestal 118 by a suitable mechanical connector or fastener, such as bolts or screws. The telescoping base 116 can be a conventional telescoping structure formed from a rigid material, such as metal or hard plastic, having an inner member 136 received within a tubular outer member 138. The inner and outer members 136, 138 may have any suitable cross-sectional shape, such as squared, rectangular, or circular. A removable pin 142, which may include a molded or padded hand grip 144, is used to lock the inner member 136 in place relative to the outer member 138 by a frictional and/or blocking engagement, as is known in the art. For example, the pin 142 may be inserted through corresponding holes or slots in the sidewall of the inner and outer members 136, 138 as shown in FIG. 4.

The telescoping base 116 is used to adjust the height of the apparatus 110 to enable use by different sized patients and for different exercises. For example, as discussed herein, when exercising the shoulder, the telescoping base 116 may be in an extended position such that the movable portion of the apparatus is positioned near to the patient's waist (e.g., when the patient is standing up). When exercising lower extremities (e.g., the hip, knee, or ankle), the telescoping base 116 is transitioned to a retracted position such that the movable portion 112 of the apparatus 110 is positioned about the height of the patient's knee.

Figure 5:
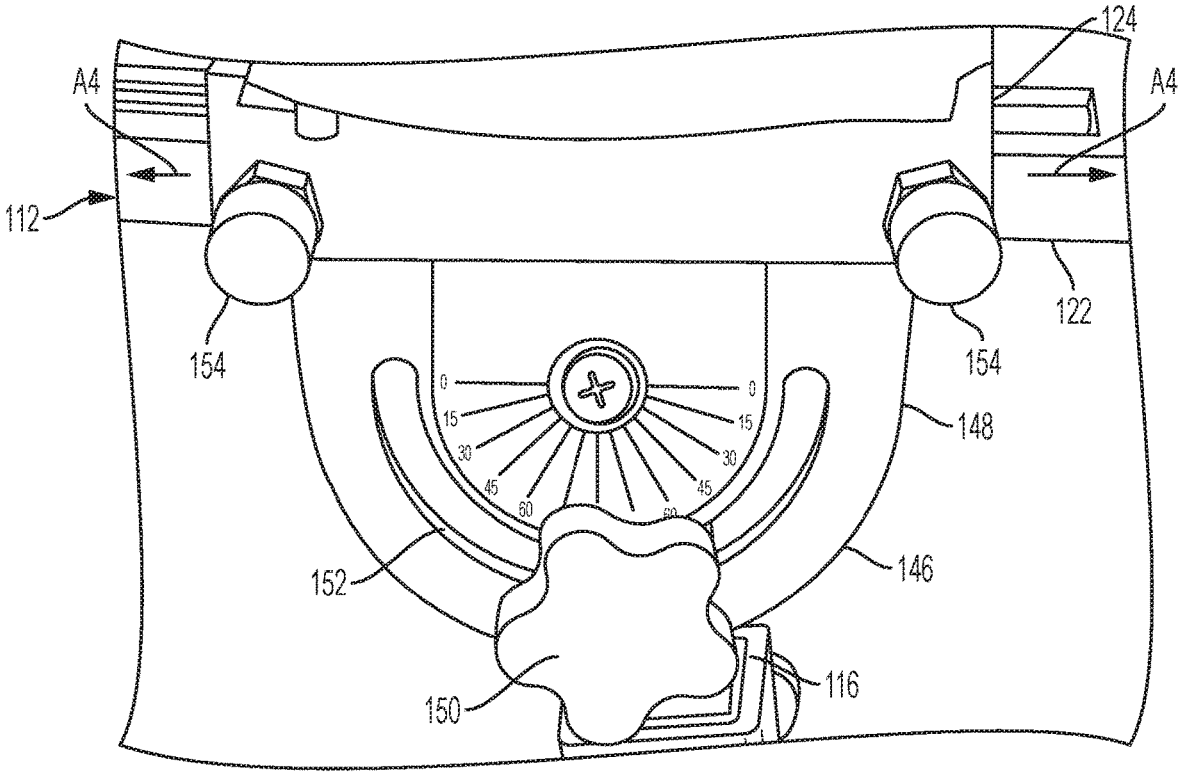
FIG. 5 is a front view of a clamp which mounts a base assembly of the stabilizing and strengthening apparatus of FIG. 2A to a first assembly thereof.

In some preferred and non-limiting embodiments, the first assembly 122 is pivotally connected to the telescoping base 116 by a clamp 146 or lock mechanism, as shown in FIG. 5. As discussed herein, adjusting the elevation angle or pitch of the first assembly 122 relative to the telescoping base 116 changes the direction of movement which can be accomplished with the apparatus 110. For example, elevation can be made steeper to make movements more difficult and/or require increased strength by the patient. Adjusting elevation angle or pitch can be a requirement of a joint specific protocol for a particular patient. Further, adjusting elevation angle or pitch over the course of treatment allows for progressive increases and/or adjustment of joint range of motion, resistance, and intensity of exercises being performed according to a treatment protocol. In some instances, adjusting elevation angle and/or pitch may make certain motions easier to perform, especially for passive range of motion exercises and gravity-assisted passive range of motion exercises and movements.

The clamp 146 may include a body 148 fixed to the first assembly 122 and including a semi-circular slot 152 sized to receive a removable pin 150. The pin 150 can be configured to engage a portion of the telescoping base 116 to maintain a fixed angle between the telescoping base 116 and the motion portion 112 of the apparatus 110. The pin 150 can be a conventional pin having a grip on a proximal end thereof and a distal end configured to be inserted in a corresponding hole of the telescoping base 116. The telescoping base 116 may include multiple holes positioned so that the elevation of the first assembly 122 can be adjusted at discrete increments such as, for example, increments of 10 degrees to 20 degrees, and preferably about 15 degrees. In some cases, the clamp body 148 can include graduations or markings showing the discrete increments, as shown in FIG. 5. In some examples, the clamp body 148 is connected to the first assembly 122 by removable connectors, such as spring clamps 154. A user may release the spring clamps 154 and slide the first assembly 122 through the clamp body 148 in the direction of arrow A4 to adjust positioning of the apparatus 110 if needed.

In other examples, the base assembly can include a substantially vertical rail extending from a pedestal, rather than a telescoping base assembly. In that case, a sliding carriage can be mounted to the rail and configured to slide along the rail to adjust a height of the apparatus. The carriage can be locked in place along the rail by a clamp or locking mechanism as is known in the art. As in previously-described embodiments, a motion portion of the apparatus can be mounted to the clamp. For example, portions of the above-described first assembly 122 (shown in FIGS. 2, 3A, 3B, and 5) can be mounted directly to the clamp. The clamp can be pivoted relative to the vertical rail to adjust the pitch of the clamp and attached motion portion of the apparatus. In some embodiments, the carriage can be formed from separate pieces, which can rotate or pivot relative to one another to provide another degree of freedom of rotation, which increases adjustability for the apparatus.

Motion Portion of the Apparatus

Figure 6:
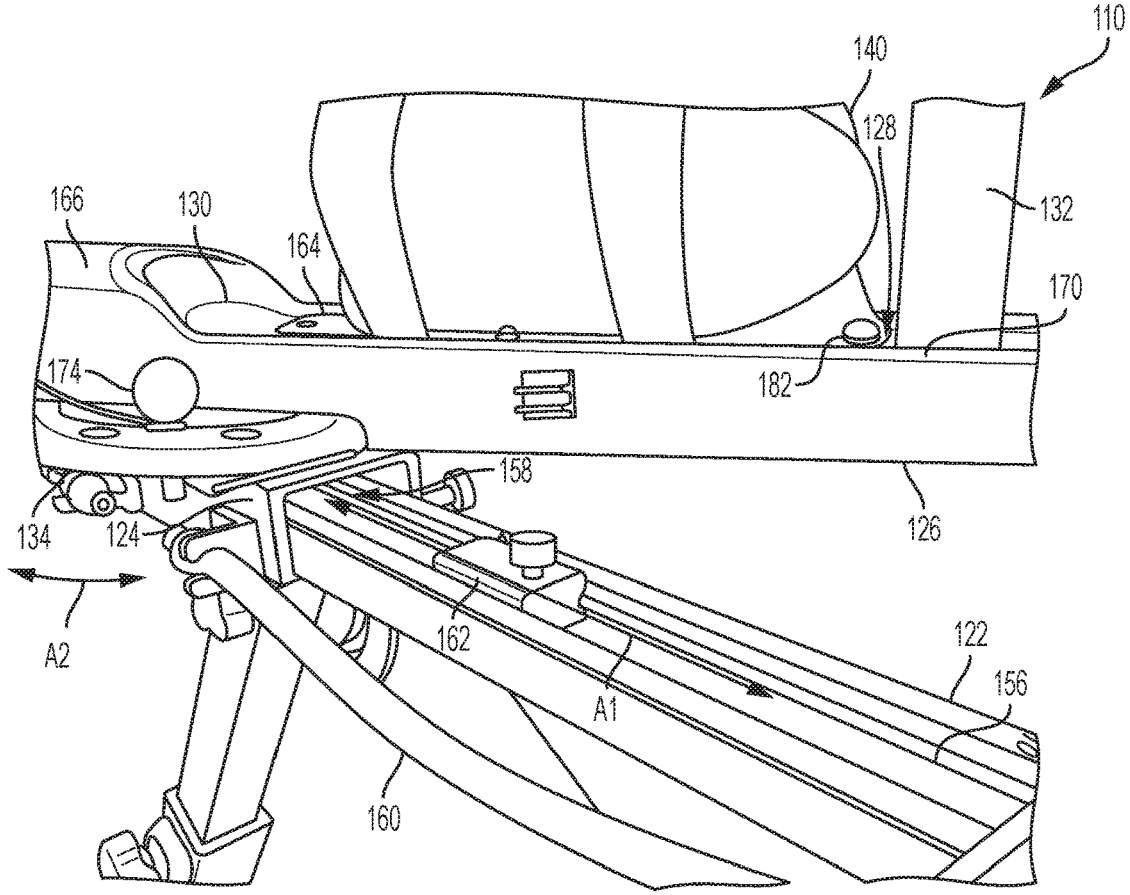
FIG. 6 is a perspective view of the first assembly of the stabilizing and strengthening apparatus of FIG. 2A.

With reference to FIG. 6, in some preferred and non-limiting embodiments, the first assembly 122 includes or defines a track 156 extending longitudinally therethrough. As shown in FIG. 6, the second assembly 124 is mounted to and configured to slide along the track 156 in one direction or the other, as shown by arrow A1. For example, the second assembly 124 may include a substantially hollow receiving portion 158 configured to receive or rest against the track 156. The receiving portion 158 may include various casters, wheels, or lubricated surfaces to allow the second assembly 124 to slide relative to the first assembly 122.

In some examples, the second assembly 124 may include locking or latching structures to hold the second assembly 124 in place along the track 156, such as the spring clamps 154 (shown in FIG. 5). The spring clamps 154 may be positioned to protrude into the receiving portion 158 of the second assembly 124 and press against the track 156 to lock the first assembly 122 in position.

While the track 156 shown in FIGS. 2A, 2B, 3A, and 3B is a linear track for straightline motion of affected joints, such a configuration should not be construed as limiting. Instead, the track 156 may define a variety of movement patterns or directions depending on therapeutic needs of particular patients. For example, the track 156 can have a zig-zag configuration which requires the patient to move the target joint to the right and left and back and forth pattern simultaneously. In other examples, the track 156 can include one or more curved portions or arcs. Including different track patterns can require the patient to practice and improve muscle control and fine motor skills while performing strength improving exercises. For example, a patient who has suffered from a stroke may benefit from practicing moving his/or hand, arm, shoulder, or foot in more complex movement patterns to reestablish muscle control. In some examples, the track 156 may be removable from the apparatus 110 and can be replaced with a track for a different movement pattern. In this way, the apparatus 110 can be adapted for use with various movement patterns including, but not limited to, straightline movement patterns, zig-zig movement patterns, curved movement patterns, and any combination thereof.

The second assembly 124 may further include biasing or resilient structures for restricting the sliding movement of the second assembly 124 relative to the first assembly 122. As discussed hereinabove, the patient attempts to move the second assembly 124 relative to the first assembly 122 to overcome the biasing force of the bands to build muscle strength. In that case, the second assembly 124 may have a natural position substantially in the middle of the track 156. The second assembly 124 may be biased to return to the natural position in response to, for example, the resilient biasing member, such as an elastic and/or resilient band 160. The band 160 is configured to impart a substantial resistance force to counteract movement of the second assembly 124 relative to the first assembly 122. The resistance force can be used to build or rebuild muscle strength during performance of rehabilitation exercises. While a variety of different types of bands or resistance structures can be used for this purpose, in general, resistance bands having a resistance of between 25 lbs. and 75 lbs. are used with the apparatus 110. However, this range is not to be construed as limiting, as certain exercises and motions may require or may be performed with below or above this range. Further, resistance of the bands may be substantially increased or decreased based on patient size, strength, athletic ability, injury history, and other factors.

Figure 7:
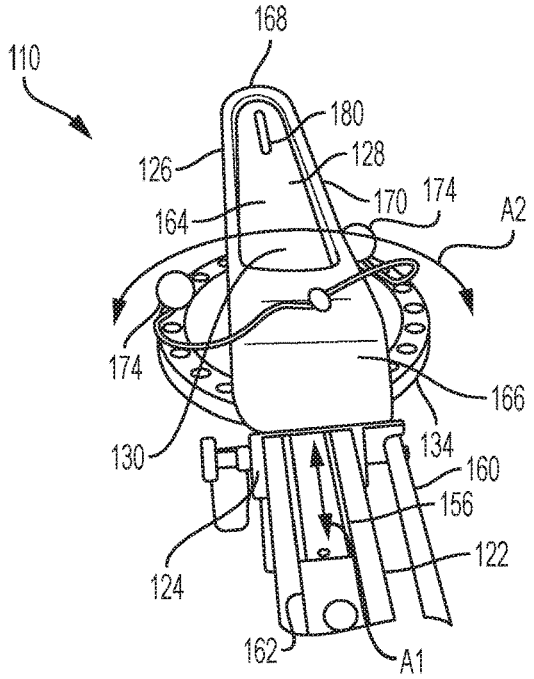
FIG. 7 is a perspective view of the third assembly showing pins placed to limit range of motion thereof.

In some examples, the first assembly 122 further includes one or more mechanical stops 162 for limiting the range of motion of the second assembly 124 along the track 156. The stop 162 can be disposed within the track 156 as shown in FIGS. 3A, 6, and 7, and positioned to prevent the second assembly 124 from advancing any farther toward the end of the track 156. In some examples, the stop 162 can be a spring-loaded protrusion or pin configured to extend into a hole or slot disposed along a bottom of the track. As with the clamp 154 between the base assembly 114 and the first assembly 122, the stop 162 can be placed at discrete intervals as shown in FIG. 6. For examples, the intervals are marked at distances of 2 inches.

As will be appreciated by one of ordinary skill in the art, being able to limit the range of motion allows the patient or therapist to adjust the apparatus 110 for use with different types of exercises and different sized patients. For example, exercises for the arm and shoulder may only require a short range of motion, while exercises for the knee or hip may require a longer range of motion. In a similar manner, taller individuals may require a longer range of motion for certain exercises. In other examples, range of motion can be limited based on treatment needs of particular patients. For example, patients that have recently undergone surgery may have a rather limited range of motion. In that case, stops 162 may be placed in the track 156 to prevent the patient from overextending any recovering joints or muscles. As the patient heals from the surgery, the range of motion can be increased by adjusting position of the stops 162.

With continued reference to FIGS. 3A, 6, and 7, in some preferred and non-limiting embodiments, the third assembly 126 is rotatably mounted to the second assembly 124 at a pivot point or coupling 134. Exercises are performed by rotating the third assembly 126 in a back and forth manner in the direction of arrow A2 about the coupling 134. For example, exercises such as internal and external rotation of the shoulder or knee can be performed by rotating the third assembly 126 relative to the second assembly 124. The third assembly 126 generally includes an elongated molded support or tray 164 extending from a proximal end 166, positioned adjacent to the coupling 134, and a distal end 168 positioned opposite the proximal end 166. The molded tray 164 of the third assembly 126 can include a substantially flat surface (e.g., a top surface 128) on which the patient may rest a portion of an arm, foot, leg, or other limb. A raised lip 170 or border may extend circumferentially around the flat surface 128. At the proximal end 166 of the tray 164, the flat surface 128 and lip 170 may form a pocket or curved surface or region, referred to herein as an elbow or knee cup or cradle 130. The elbow or knee cradle 130 may be sized and shaped to comfortably receive the patient's elbow or knee and to provide support for the elbow or knee. In particular, the cradle 130 is positioned to prevent the respective joint from sliding off and/or away from the third assembly 126. A removable handle 132 may be disposed on the distal end of the third assembly 126. When the apparatus 110 is used for shoulder or elbow exercises, the patient grasps the removable handle 132 to maintain positioning of the arm and elbow along the third assembly 126. When the apparatus 110 is used for exercises for other joints and/or body positions, the handle 132 is removed, as shown in FIG. 7. For example, when performing exercises for the knee or hip, the handle 132 may be removed so that the patient may rest his/her leg on the flat surface of the base.

The third assembly 126 is configured to rotate freely around the pivot point or coupling 134 in the direction shown by arrow A2. However, the third assembly 126 may include one or more pins 174, clamps, or locking mechanisms positioned to block rotation of the third assembly 126 relative to the second assembly 124 to limit range of motion of exercises that can be performed by rotation of the third assembly 126. An exemplary clamping mechanism including pin(s) 174 for the third assembly 126 is shown in FIG. 7. For example, as in previously-described embodiments including clamping mechanism for limiting movement or rotation of one of the assemblies 122, 124, 126, pin(s) 174 may be placed at discrete intervals, such as an interval of between 5 degrees and 15 degrees. However, these values are merely exemplary and are not intended to limit the scope of the present invention in any way. Instead, for some applications intervals of 1 or 2 degrees may be used. In other examples, larger discrete intervals of 30 degrees or more may be needed. In other examples, the third assembly 126 or clamping mechanism may instead include a continuous track or slot, rather than discrete clamping positions, so that a user has even greater selectivity for range of motion. As shown in FIG. 7, in one exemplary embodiment, a first pin is placed at 45 degrees counter-clockwise relative to a longitudinal axis of the elongated first assembly 126. A second pin is placed at 15 degrees clockwise relative to the longitudinal axis of the first assembly 122 giving a total range of motion of about 60 degrees.

In some preferred and non-limiting embodiments, a riser or spacer may be positioned between the second assembly 124 and the tray 164 of the third assembly 126. For example, the riser or spacer may be a support member, such as a metal block, wood board, or molded plastic structure, creating a space between the tray 164 and the sliding second assembly 124. The space between the assemblies 124, 126 can be from about 2 to 12 inches or more depending on types of exercises that will be performed using the apparatus 110. This space between the assemblies 124, 126 can make it easier to use the apparatus 110 by, for example, increasing a distance between the patient's extremities and the track 156 or other movable portions of the apparatus 110. Accordingly, the patient is less likely to contact the track 156 or other movable portions of the apparatus 110 while performing exercises. For example, a patient performing knee exercises kneels on the tray 164, such that his/her foot extends in a downward direction off a rear portion of the tray 164. The foot could contact the track 156 during exercises. Including a spacer or riser between the assemblies 124, 126 increases space between the patient's foot and the track 156 so that no contact occurs. In some instances, increasing a space between the assemblies 124, 126 may allow for a greater range of motion for certain exercises since the range of motion is not limited by the track 156, base 116, or other portions of the apparatus 110.

In some preferred and non-limiting embodiments, the spacer or riser is fixedly mounted to the second assembly 124 and/or the third assembly 126. In other preferred and non-limiting embodiments, the spacer or riser can be slidably connected to the second assembly 124 and/or to the third assembly 126 to allow the spacer or riser to slide in one or more directions relative to the assemblies 124, 126. For example, the spacer or riser could slide left and right relative to the second assembly 124 to provide adduction and abduction of a joint. The spacer or riser could also slide front to back relative to the second assembly 124 to provide supination and/or pronation of a joint.

Figure 8:
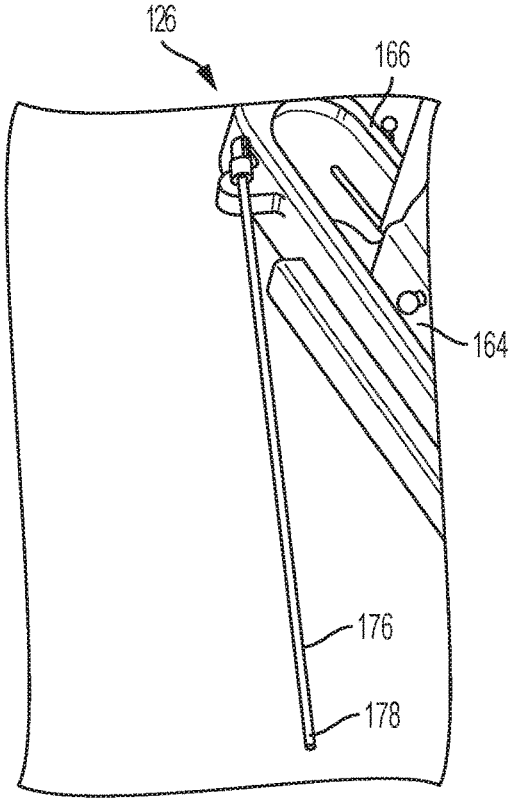
FIG. 8 is a perspective view of the third assembly of the stabilizing and strengthening apparatus of FIG. 2A including a range of motion wand.

As shown in FIG. 8, in some preferred and non-limiting embodiments, the third assembly 126 includes a range of motion wand 176 pivotally mounted to a distal end 168 of the tray 164. The range of motion wand 176 can be an elongated structure formed from a rigid material, such as metal or plastic. In some instances, the wand 176 can be removably connected to the tray 164 so that a user may switch the wand 176 from the right side to the left side thereof to accommodate different users and exercises. The range of motion wand 176 can be used by the patient or physical therapist to control range of motion for a shoulder, elbow, wrist, arm, hip, leg, or knee. The wand 176 is configured to permit a user to grasp a proximal end 178 of the wand 176 and to manipulate the third assembly 126 by pushing and pulling on the wand in the direction of arrows A1 and A2 (shown in FIGS. 3A, 6, and 7). For example, the user or patient may grasp the range of motion wand 176 with an uninjured hand and can control movement of a target joint to prevent the patient from moving the target joint beyond a desired range of motion. In other examples, the range of motion wand 176 may be used to cause passive movement of the target joint. For example, the patient or a therapist may grasp and apply pressure to the wand 176 to cause movement of the target joint in a desired direction. The wand 176 can be used to direct movement of a target joint in any direction permitted by the apparatus 110. For example, for a target hip joint, the wand 176 can be used to cause passive hip flexion, hip extension, hip abduction, hip adduction, hip internal rotation, and hip external rotation. For a shoulder joint, the wand 176 can be used to cause passive movements including, but not limited to, shoulder flexion, extension, abduction, adduction, internal rotation, external rotation, supination and pronation.

As shown in FIG. 7, in some preferred and non-limiting embodiments, the third assembly tray 164. The slot 180 is configured to receive a connector or fastener 182 extending from the brace assembly 140 (shown in FIGS. 3A and 6) to mount the brace assembly 140 to the third assembly 126. The brace assembly 140 is sized to receive and support the patient's limb or joint during exercise of a target joint. In some examples, the patient may place his/her limb in the brace assembly 140, and attach the assembly 140 to the limb with straps. In other cases, the brace assembly 140 may be sized and shaped to receive a splint, sling, orthosis, or support worn by the patient. In that case, the splint, sling, or support worn by the patient may be configured to clip into or be secured to a portion of the base assembly 140. Advantageously, the brace assembly 140 allows the patient to use the apparatus 110 without having to remove his/her limb from the splint, sling, orthosis, or support being worn. This feature is especially advantageous for post-surgical patients who are told to wear the splint or sling at all times following surgery. In other examples, a brace, splint, orthosis, or support worn by a patient may be connected directly to the third assembly 126 by, for example, by mounting the patient's support or brace to the third assembly 126 with fasteners 182, straps, or clamps.

Brace Assembly for Forearm

Figure 9:
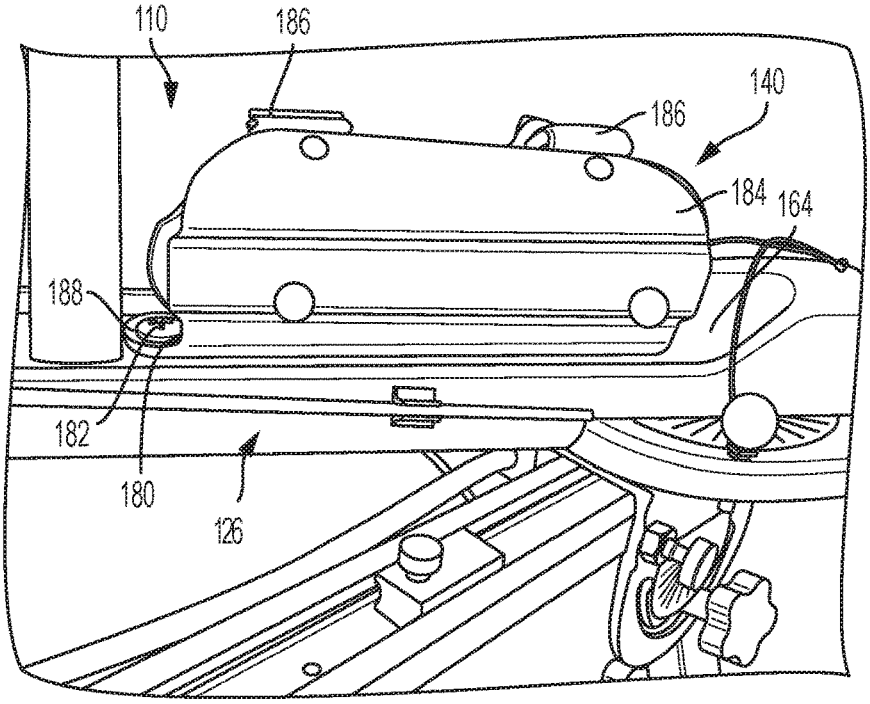
FIG. 9 is a perspective view of the stabilizing and strengthening apparatus of FIG. 2A with the brace assembly mounted thereto according to an aspect of the present disclosure.

With reference to FIG. 9, a preferred and non-limiting embodiment of the brace assembly 140 mounted to the third assembly 126 is illustrated. As discussed herein, in some preferred and non-limiting examples, the brace assembly 140 is provided to ensure post-operation safety by limiting the patient's range of motion, preventing over-extension, and providing continuous support for certain injured or healing joints and limbs. For example, the fasteners 182, such as screws or bolts, can be connected through the slot 180 for mounting the brace assembly 140 to the third assembly 126. As shown in FIG. 9, the brace assembly 140 can be a wrist orthosis or support including an elongated partially tubular plastic body 184 having a suitable curvature for supporting a patient's forearm and wrist. The patient's forearm and/or another supporting device can be clipped into or mounted to the body 184 with straps 186. As will be appreciated by one of ordinary skill in the art, the straps 186 can be cinched or tightened to hold the limb in place against the plastic body 184 to support the limb and to ensure that the limb does not slide off of the apparatus 110 during movements or exercises. The elongated body 184 includes one or more slots or holes 188 for receiving the fasteners or connectors 182 which mount the brace assembly 140 to the third assembly 126. For example, as shown in FIG. 9, the fastener 182 is received within an opening or a hole 188 of a tab extending from the brace body 184 and positioned to hold the brace body 184 in place against the tray 164. In other examples, the fastener or connector 182 can be a pin, screw, bolt, nut, or another connector configured to pass through the slot 180 of the third assembly 126 for mounting the brace to the third assembly 126. An exemplary wrist orthosis including a rigid tubular body and suitable straps for attaching a patient's forearm and wrist to the tubular body and which can be adapted for use with the apparatus 110 is disclosed in U.S. Patent Appl. Pub. No. 2014/0194798, entitled "Reconfigurable Shoulder and Arm Orthosis and Method", which is incorporated by reference in its entirety.

In use, the patient's forearm and wrist are secured by the brace body 184 in the conventional manner. Once the patient's limb is secured to the brace body 184 and the brace body 184 is secured to the third assembly 126, the patient can begin to perform exercises in the manner suggested by a therapist or physician and as described herein. For example, in order to perform exercises for the shoulder, the patient grasps the removable handle 132 and pushes against the handle 132 to cause the third assembly 126 to move in one or more directions. For example, as discussed herein, the patient may perform shoulder internal and external rotation by rotating the third assembly 126 about the pivot point or coupling 134 in the direction of arrow A2 (shown in FIGS. 6 and 7). The patient can also move his/her shoulder back and forth for retraction, elevation, abduction, and adduction (in the direction of arrow A1 in FIGS. 6 and 7). The patient can also perform other shoulder movements and exercises including one or more of: scapular protraction; scapular retraction; scapular elevation; scapular depression; shoulder elevation and flexion; and shoulder extension by adjusting elevation of the first assembly 122 relative to the base assembly 114 (shown in FIGS. 2A and 2B) as described herein.

The above-described exercises for the shoulder also cause movement of the elbow. For example, while the patient's arm and/or wrist is positioned in the brace assembly 140, elbow exercises can be performed including elbow flexion, elbow extension, forearm supination, and forearm protrusion. Specifically, flexion and extension occur by rotating the elbow in the direction of arrow A2 (in FIGS. 6 and 7) as described herein. Supination and protrusion occur by sliding the elbow in a back and forth manner to cause extension and retraction of the elbow joint by moving the third assembly 126 back and forth in the direction of arrow A1 (shown in FIGS. 6 and 7).

Advantageously, after the patient is finished performing exercises for the shoulder and/or elbow, the brace assembly 140 can be removed from the tray 164 and replaced with another type of brace assembly 140 to accommodate exercises for different joints. For example, a portable version of the apparatus 110 may be assigned to a patient recovering from shoulder surgery. The patient may connect his/her wrist or arm orthosis to the brace assembly 140 of the apparatus 110 when performing assigned exercises. When the patient completes rehabilitation, he/she can return the apparatus 110 to the healthcare facility or physical therapy clinic. The returned apparatus 110 can then be outfitted with a different type of brace assembly 140, as described herein, for use by a patient recovering from another type of surgery or injury.

Other Brace Arrangements

Figure 10:
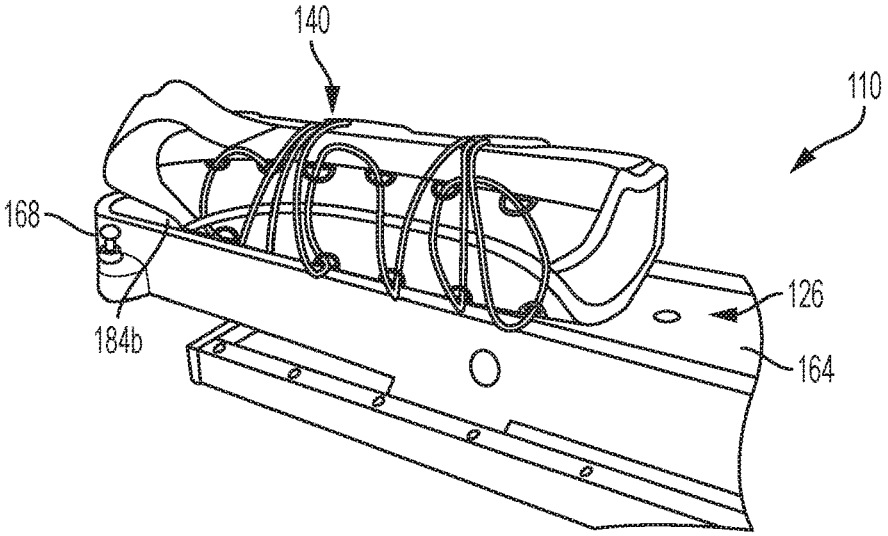
FIG. 10 is a perspective view of a wrist brace mounted to the stabilizing and strengthening apparatus of FIG. 2A.

As previously described, the apparatus 110 is adjustable and can be used for performing exercises and movements for different target joints. As such, many different types of braces and patient supports can be mounted to the apparatus 110 depending on therapeutic needs or particular patients. Different types of braces are shown mounted to the tray 164 of the third assembly 126 in FIGS. 10-13. For example, as shown in FIG. 10, in a preferred and non-limiting embodiment, the brace assembly 140 can include a hand brace 184*b* configured to support the patient's palm, hand, and wrist. The hand brace 184*b* is configured to be mounted to the distal end 168 of the tray 164. Since the patient's hand and wrist are supported by the brace 184*b*, the handle 132 (shown, for example, in FIG. 3A) is removed, and the brace 184*b* is positioned at or adjacent to the distal end 168 of the tray 164. The hand brace 184*b* can be connected to the tray 164 of the third assembly 126 using fasteners or connectors (e.g., screws or bolts) as described hereinabove.

In use, the patient's hand and wrist are secured to the wrist/hand brace 184*b* in a conventional manner by, for example, cinching straps or elastic cords positioned around the forearm, wrist, and proximal portion of the hand. While secured to the wrist brace 184*b*, the patient can perform exercises including wrist flexion, wrist extension, wrist ulnar deviation, wrist radial deviation, wrist/hand supination, and wrist/hand pronation. The patient may also perform hand exercises including palmar flexion, palmar extension, flexion of all digits, and extension of all digits.

Figure 11:
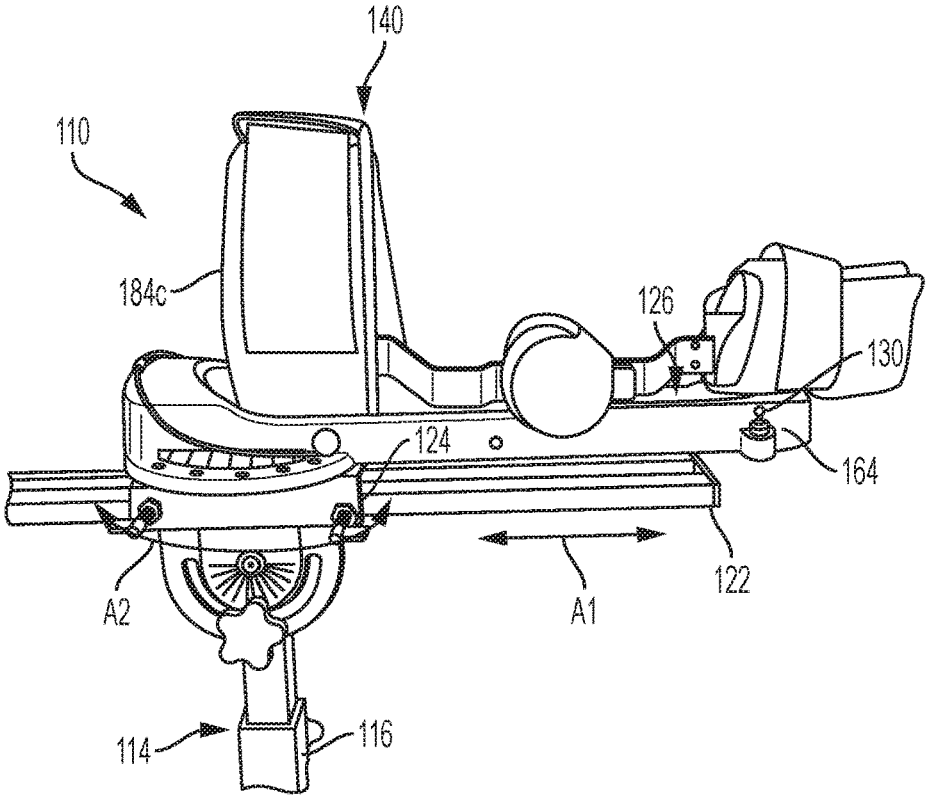
FIG. 11 is a perspective view of a hip brace for the upper thigh and knee mounted to the stabilizing and strengthening apparatus of FIG. 2A.

As shown in FIG. 11, in another preferred and non-limiting embodiment, the apparatus 110 is configured for performance of hip and knee exercises or movements. As shown in FIG. 11, a brace 184*c* for the upper thigh and/or knee is mounted to the third assembly 126. Hip motions, which can be performed using the apparatus 110 include hip flexion, hip extension, hip internal rotation, hip external rotation, hip abduction, and hip adduction. The apparatus 110 can also be configured to permit movement and/or exercise of both the hip and knee simultaneously. For example, exercises including hip and knee flexion and hip and knee extension can be performed by increasing the range of motion so that both the hip and knee flex and/or extend as the third assembly 126 slides or rotates relative to the second assembly 124.

In use, a patient or user prepares the apparatus 110 for exercising the hip and/or knee by first removing the handle and decreasing the height of the telescoping base 116 so that the tray 164 of the third assembly 126 is about the same height as the patient's knee when standing up. The patient then kneels on the tray 164, placing his/her knee in the knee cup or cradle 130. The patient's lower leg is secured to the knee or leg brace 184*c* using straps in the conventional manner. The patient is then permitted to move his/her leg in a back in forth motion in the direction of arrow A1 in FIG. 11. Such back in forth movement permits and/or causes extension and flexion of the hip and knee depending on the set or selected range of motion. Rotating the tray 164 relative to the first assembly in the direction of arrow A2 permits internal rotation, external rotation, abduction, and adduction of the hip. Rotating the tray 164 relative to the first assembly may also permit twisting or extension of the knee.

In other examples, hip exercises can be performed by the patient while remaining in a substantially standing position. For example, the first assembly 122 can be rotated to a substantially vertical position relative to the base assembly 114. The patient's upper leg can be secured to the third assembly using the leg brace 184*c*. Hip flexion and extension may then be performed by rotating the third assembly 126 relative to the second assembly 124 in a suitable back and forth manner. This position may be useful, for example, when a patient needs to keep his/her knee substantially straight while performing hip exercises.

Figure 12:
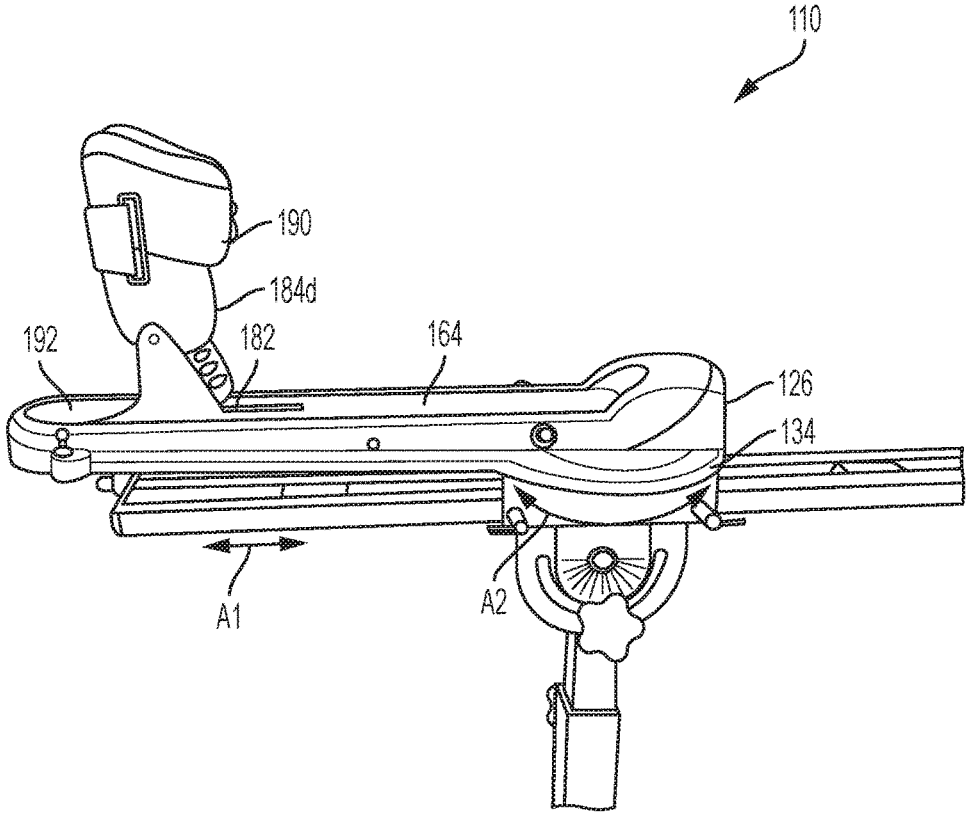
FIG. 12 is a perspective view of a foot/ankle brace mounted to the stabilizing and strengthening apparatus of FIG. 2A.
Figure 13:
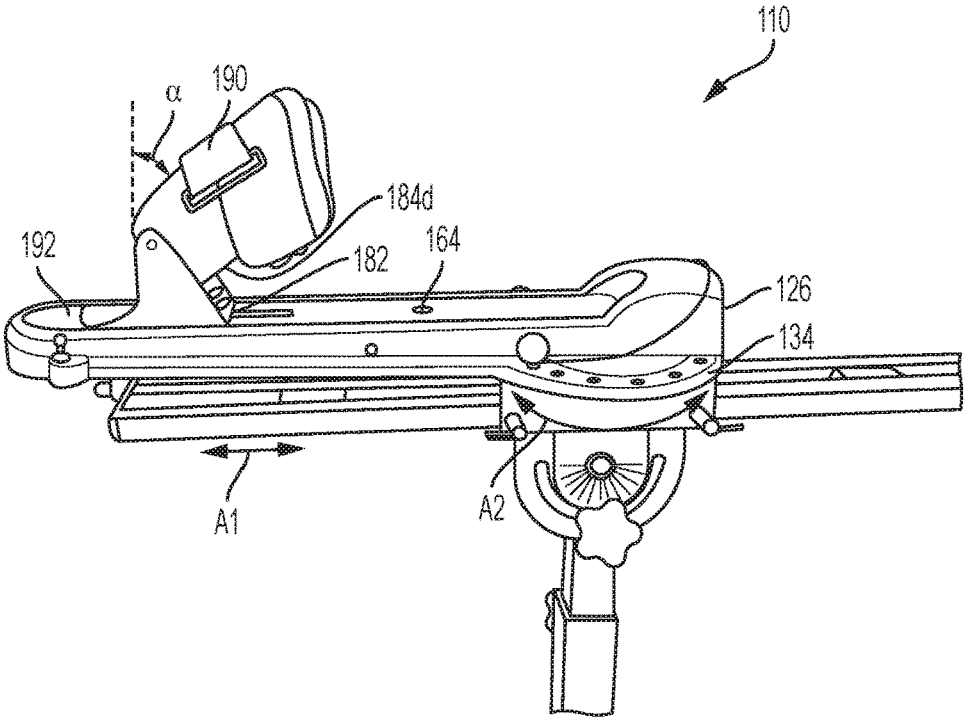
FIG. 13 is another perspective view of the foot/ankle brace of FIG. 12 in another orientation.

In another preferred and non-limiting embodiment, as shown in FIGS. 12 and 13, a brace 184*d* for the foot and/or ankle can be mounted to the tray 164 of the third assembly 126. The foot brace 184*d* can be a conventional foot brace including a substantially vertical upper portion 190 having a collar configured to be positioned above the patient's ankle and a substantially horizontal foot plate or foot portion 192 pivotally mounted thereto. Connectors or fasteners 182 may by mounted to the foot portion 192 for connecting the brace 184*d* to the tray 164. The foot brace 184*d* can be used to perform exercises and movements for the ankle including plantar flexion, dorsiflexion, inversion, and eversion. The foot brace 184*d* can also be used to perform foot motions including hallux flexion and extension, flexion and extension of phalanges and toes, and self-myofascial release to plantar fascia.

In use, the telescoping member 116 (shown, for example, in FIGS. 2A and 2B) is retracted so that the third assembly 126 of the apparatus 110 is close to the ground. The patient sits in a chair and his/her foot is secured to the apparatus 110 by the foot brace 184*d*. In some instances, the upper portion 190 of the foot brace 184*d* is substantially vertical as shown in FIG. 12. In that case, the patient's lower leg will also be in a substantially vertical position. In other examples, the upper portion 190 of the foot brace 184*d* can be angled so that the patient's ankle is slightly extended as shown in FIG. 13. Specifically, as shown in FIG. 13, the upper portion 190 is at an angle $\alpha$ of about 30 degrees relative to vertical. Ankle dorsiflexion and/or plantar flexion can occur by sliding the third assembly 126 back and forth in the direction of arrow A1. Rotation of the ankle can occur by rotating the third assembly 126 about the coupling 134 in the direction of arrow A2. Since the ankle only has a limited range of motion (e.g., about 30 degrees or less) pins 174 (shown in FIG. 7) may be positioned to limit the range of rotation of the ankle to a small amount.

Patient Monitoring and Reporting Systems

According to another aspect of the disclosure, the apparatus 110 is integrated with sensing and electronic components for tracking and recording information about exercises performed by the patient, including, for example, force exerted by the movements, speed of movement, and range of motion. The recorded information can be collected by a controller or suitable processing circuitry, transmitted from the apparatus to a remote source, and collected in a suitable database or electronic patient record. For example, the controller can be a general-purpose computer microprocessor, specialized computer processor adapted for use with the apparatus 110, or another type of processing hardware or software as is known in the art. Collected information can be presented to a physician or caregiver, as a patient report to show whether the patient was able to complete assigned movements or exercises, to show patient improvement or deterioration over time, and to assist the physician or caregiver in preparing updated exercise or treatment protocols for some patients.

Figure 14C:
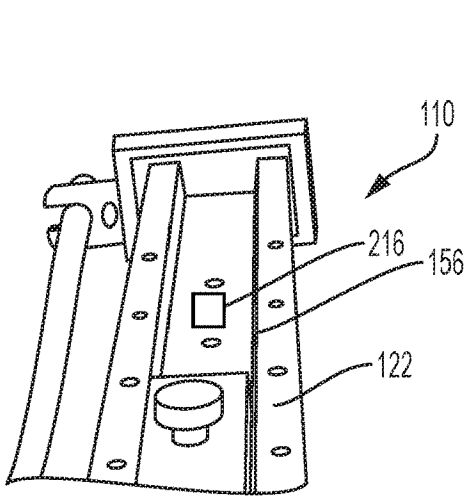
FIGS. 14A-14C are schematic drawings illustrating positioning of sensors for measuring information about use of a stabilizing and strengthening apparatus by a patient according to an aspect of the disclosure.
Figure 14B:
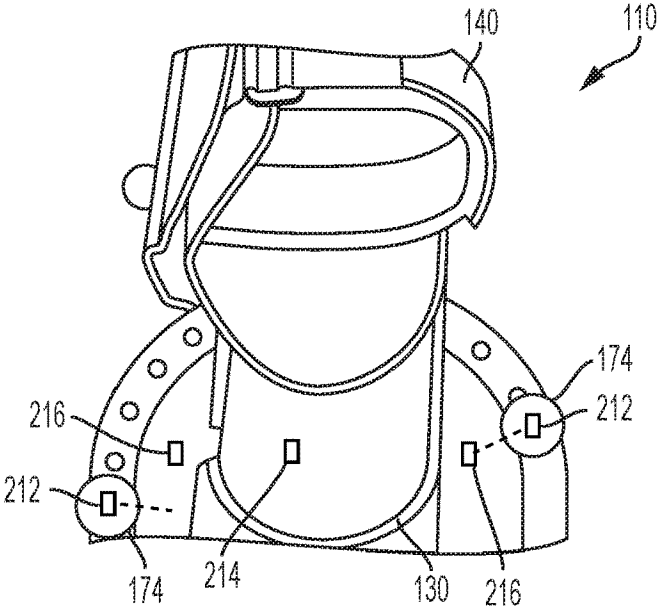
Figure 14A:
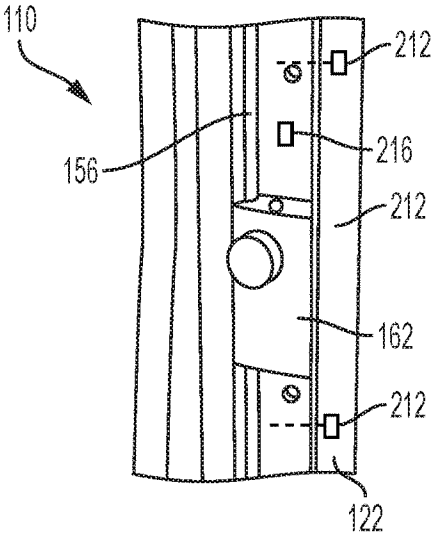

As shown in FIGS. 14A-14C, in some preferred and non-limiting embodiments, sensors 212, 214, 216 can be placed at different portions of the apparatus 110 to collect different information about the patient and/or apparatus. For example, position or proximity sensors 212 may be placed on or adjacent to the stops 162 and pins 174 to determine and record information about how the apparatus 110 is set up, what types of movement are being performed, and what range of motion is being permitted. For example, in formation from the position or proximity sensors 212 may be used to measure angle or pitch of the telescoping base 116 (shown in FIGS. 2A and 2B). The position or proximity sensors 212 can be, for example, simple contact sensors that measure what hole(s) of the clamp or coupling a pin is inserted into. In a similar manner, the position or proximity sensors 212 can be positioned at discrete intervals along the track and configured to indicate which of the sensors 212 is closest to the stop 162. In other examples, the position or proximity sensors 212 may be a distance sensor configured to measure, for example, how far a stop 162 is positioned from an end of the track. Information from the position or proximity sensors 212 can be used to assess what range of motion the patient or user has set. If, for example, a patient has set a range of motion that is greater than a safe or clinically acceptable level for the exercises being performed by the patient, the apparatus 110 may be configured to provide a notification to the user and/or patient alerting him/her of the discrepancy.

In some examples, touch or pressure sensors 214 may also be placed on portions of the apparatus 110 configured to receive the patient's arms, elbows, legs, knees, or feet. For example, the touch or pressure sensors 214 may be placed on the knee cradle 130, handle 132, and/or on portions of the brace assembly 140. Information from these touch or pressure sensors 214 can be used, for example, to confirm that the patient is in the correct position to begin performing prescribed exercise and is using the apparatus 110 in the prescribed manner. For example, if the patient's elbow or knee is not pressed into the cup or cradle 130, it may signify that the patient's elbow or knee is not properly supported as exercises are being performed and/or that the patient is not performing the correct exercise. In a similar manner, information about an amount of pressure or force exerted by the patient on the cradle 130, brace assembly 140, or handle 132 (shown in FIG. 3A) may be used to assess whether the patient is using the correct technique when performing exercises. For example, higher than expected pressure on the elbow or knee may suggest that the patient has poor posture and/or is leaning too heavily on the knee or elbow while performing the exercises. Such issues may be addressed by using a different type of brace or by adjusting the height of the telescoping member 116 (shown in FIGS. 2A and 2B) or the orientation of the first assembly 122. For example, slightly increasing the elevation angle of the first assembly 122 would adjust an amount of pressure exerted on the cradle 130 by the patient's elbow or knee.

In some examples, certain force or velocity sensors 216 may be positioned at movable portions of the apparatus to assess a force or speed of movement exerted by the patient. A velocity sensor can include one or more position sensor disposed on the apparatus 110 for measuring how far a particular component of the apparatus 110 travels over time. The velocity sensor may also comprise one or more accelerometers. Acceleration information obtained by the accelerometers can be processed and/or integrated to determine velocity. A force sensor can be a piezoelectric transducer, pressure transducer, and/or mass sensor or scale, as are known in the art. In some examples, one or more force or velocity sensors 216 may be positioned along the track 156 of the first assembly 122 to determine speed or force as the second assembly 124 slides along the track 156 of the first assembly 122. In a similar manner, force and/or velocity sensors 216 may be positioned on or adjacent to the coupling 134 between the second assembly 124 and the third assembly 126 to obtain information about a rotation speed or torque about the coupling 134.

Figure 15:
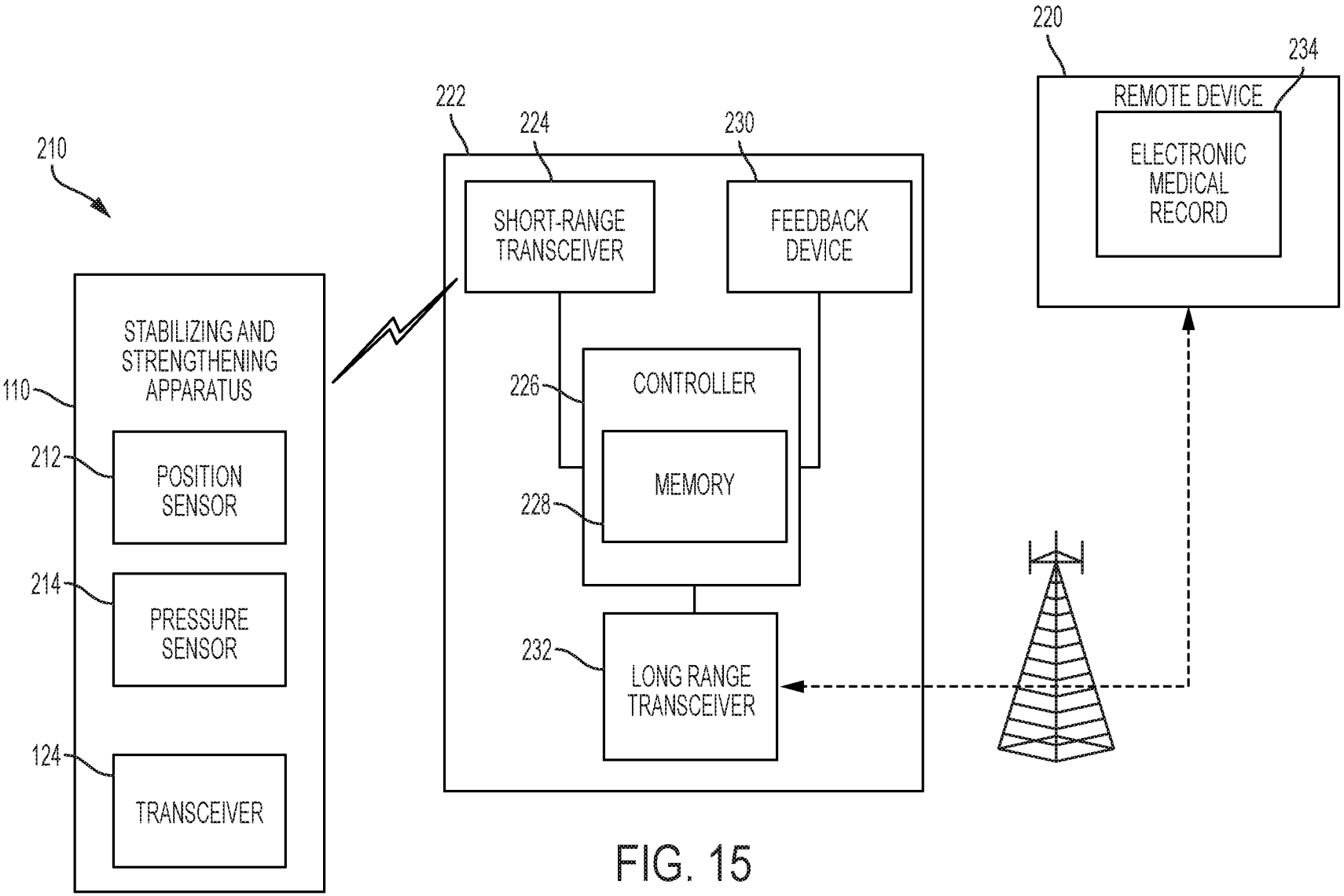
FIG. 15 is a schematic drawing of a system for collecting and analyzing information from sensors mounted to a stabilizing and strengthening apparatus according to an aspect of the disclosure.

As shown in FIG. 15, a preferred and non-limiting embodiment of a system 210 for obtaining information about use of the stabilizing and strengthening apparatus 110 is illustrated. The system 210 is arranged to obtain information from the sensors 212, 214, 216 and to transmit the information to a remote facility or device 220, such as a central processing facility, computer network, database, or the Internet. In some examples, the system 210 includes the remote device 220, the apparatus 110 and the plurality of sensors 212, 214, 216 mounted thereto, and an intermediate device 222 for receiving information from the sensors 212, 214, 216 and for transmitting the received information to the remote device 220.

As shown in FIG. 15, the sensors 212, 214, 216 are in wired or wireless communication with the intermediate device 222. For example, information may be sent from the sensors 212, 214, 216 to the intermediate device 222 by a short-range data transmission component such as a Bluetooth® transceiver or by another radio-frequency and/or near-field communication transmission component. The intermediate device 222 can be any suitable general purpose computing device or dedicated electronic device having data transmission circuitry for receiving information from the sensors 212, 214, 216. For example, the intermediate device 222 can be a smartphone, tablet, computer, laptop computer, or similar computer device. In other examples, the intermediate device 222 can be a dedicated electronic device connected to the apparatus 110 and configured to controls aspects of operation of the apparatus.

The intermediate device 222 can generally include a short-range wireless transceiver 224 for receiving the information from the sensors 212, 214, 216 and a controller 226 configured to receive and process the received information. The controller 226 can be associated with transitory and non-transitory computer readable memory 228 including instructions for operating the controller 226 and, as described herein, for receiving and processing information from the sensors 212, 214, 216. In particular, in some preferred and non-limiting embodiments, the intermediate device 222 is configured to analyze the received information to confirm that exercises are being performed safely and/or in accordance with prescribed protocols. If, for example, range of motion is too large for certain exercises, the intermediate device 222 may provide a notification to the user or patient through, for example, a visual and/audio feedback device 230, such as a visual display and/or speaker. In a similar manner, if movements are being performed too quickly or if the patient is applying too much force to the apparatus 110, an appropriate notification may be provided.

In some preferred and non-limiting embodiments, the intermediate device 222 also includes a long range data transceiver 232, such as a wireless or cellular transceiver, for transmitting information from the intermediate device 222 to the remote device 220. Information can be sent continually or at predetermined intervals. In some instances, the intermediate device 222 may be configured to collect all data for a particular exercise session. The collected information can then be uploaded to the remote device 220 as a single batch upload. In other examples, uploads can be initiated manually by a patient or caregiver. For example, a patient may be instructed to send information from an exercise session periodically so that a physician can track whether the patient is performing tasks correctly. In still other examples, uploads can be initiated remotely. For example, a physician or technical service representative may remotely initiate a data upload to see how a patient is progressing and/or adhering to the assigned treatment protocol.

With continued reference to FIG. 15, in some preferred and non-limiting embodiments, the remote device 220 is a computer network or computer database located at a central data collection facility. For example, the central data collection facility may be operated by a telemedicine service provider, hospital, insurance provider, or physical therapy clinic. Information received by the central facility can be analyzed manually by a service technician or medical professional. As described herein, the received information may also be analyzed automatically to, for example, prepare patient reports, track progress of multiple patients, and/or to update patient medical records to accurately describe rehabilitation efforts by the patient.

In some examples, the remove device 220 is configured to receive the information from the intermediate device 222, analyze the received information to identify how the apparatus 110 is being used, and generate an output or report based on the information. For example, a physician report may be generated from the received information and made available to a treating physician over a website, web portal, or remotely accessible computer database. The physician report can include a plurality of patient and rehabilitation parameters including range of motion and resistance settings of the apparatus 110, number of movements or exercises performed, average speed or force for each movement, average time between exercises, average number of exercises performed before taking a break, and/or information about adherence to particular treatment protocols. For example, the physician may be able to see information including a number of exercises or movements performed by the patient over the course of a rehabilitation effort and/or an average number of exercises or movements performed each day.

In some examples, information in the patient report is useful for managing patient compliance with assigned protocols or exercise regimens. As used herein, patient compliance refers to whether a patient successfully completes assigned tasks within a prescribed time period. In some examples, patient compliance can be documented or measured as a completion percentage of the assigned protocol. For example, patient compliance may be shown as a percentage of assigned exercises completed. The report may also include exercise parameters representative of a quality, duration, and/or intensity of exercises performed with the apparatus 110. For example, the exercise parameters can include information about an amount of force which the patient is able to exert during the movements, speed of different movements, average acceleration of different muscle groups, distance traveled by the second assembly along the track during each exercise, average pause between exercises, and others. In some instances, the reports can include graphs illustrating changes in force measurements over time to show if the patient is progressing. It is believed that the combination of patient compliance information and information about patient progress can be used to compare reported patient data to clinical performance standards at different post-operative or post-injury periods or times or milestones. The comparison can be used to assess whether a patient is above, below, or at an expected level of performance for the different post-operative or post-injury periods of time. Further, based on the patient reports, observers are able to determine what type of protocols have high levels of patient compliance. In some cases, observers may also be able to determine whether lack of patient improvement can be attributed to unhelpful treatment protocols or exercise regimens or to low levels of patient compliance.

In some examples, the remote device 220 is configured to receive information from a plurality of exercise apparatuses 110 and, optionally, to generate reports for groups of patients with similar characteristics (e.g., all patients being treated by one therapist or caregiver or for all patients being treated at a particular rehabilitation facility). For example, the remote device 220 may be configured to receive information from the plurality of exercise apparatuses 110 and to associate the received information with a particular patient. Information for each patient may be placed in a patient's electronic medical record 234 and made available to the patient's physician or caregiver as a patient report. Information from multiple patients may be combined together into a single report or database, desirably, in a manner which preserves each patient's privacy and/or anonymity. For example, data for patients treated by a single physical therapist may be combined together to show whether the therapist is achieving desired patient outcomes. Patient outcomes for different therapists may be considered or compared for training or reviewing purposes. In a similar manner, patient outcomes or patient compliance can be compared for different physical therapy clinics or facilities. For example, an average patient compliance or progress level or score may be calculated based on all patients at a particular clinic or facility that are using the apparatus 110. Scores for different facilities may be compared for review and training purposes.

The embodiments have been described with reference to various examples. Modifications and alterations will occur to others upon reading and understanding the foregoing examples. Accordingly, the foregoing examples are not to be construed as limiting the disclosure.

The invention claimed is:

1. A multi-position stabilizing and strengthening apparatus for use in exercising different target joints, the apparatus comprising:

a height adjustable elongated base defining a vertical axis;

a first assembly comprising a track mounted to a portion of the base, the track defining a movement pattern for at least one target joint of a patient;

a second assembly slidably mounted to the track of the first assembly to permit motion of the second assembly relative to the first assembly as defined by the movement pattern along the track to move the at least one target joint towards flexion or towards extension, wherein the second assembly slides along the track towards or away from the vertical axis defined by the elongated base;

a third assembly comprising a tray sized to receive a portion of a limb and/or joint of the patient, the third assembly being rotatably mounted to the second assembly at a pivot point to permit relative in-plane rotational motion of the third assembly relative to the second assembly about the pivot point for internal and external rotation of the at least one target joint; and a brace assembly fixedly mounted to the tray of the third assembly configured to receive portions of the joint and/or limb of the patient, thereby securing the joint and/or limb of the patient to the third assembly so that the at least one target joint can be exercised by movement of the first, second, and third assemblies relative to one another.

2. The apparatus of claim 1, further comprising a removable handle mounted to the tray of the third assembly through a slot extending through a portion of the tray, the removable handle being configured to be grasped by the patient when performing shoulder and/or elbow exercises, wherein the removable handle is configured to be removed from the tray of the third assembly to permit the patient to perform exercises of a hand, wrist, hip, knee, foot, and/or ankle.

3. The apparatus of claim 1, wherein the movement pattern defined by the track comprises movement in a plane defined by a top surface of the track in one or more of a straightline movement pattern, a zig-zag movement pattern, a curved movement pattern, and any combination thereof.

4. The apparatus of claim 1, further comprising one or more movable stops disposed within the track of the first assembly for limiting the motion of the second assembly relative to the first assembly.

5. The apparatus of claim 1, further comprising a coupling lock between the second assembly and the third assembly, wherein the coupling lock is configured to receive one or more pins for limiting a range of rotation of the third assembly relative to the second assembly.

6. The apparatus of claim 1, wherein the tray is an elongated molded structure comprising a proximal end mounted to the second assembly, a distal end opposite the proximal end, and a substantially flat surface extending therebetween, and wherein the tray further comprises a cradle at the proximal end thereof shaped to receive a portion of a joint of the patient and a longitudinally extending slot positioned at the distal end thereof.

7. The apparatus of claim 1, wherein the brace assembly comprises a brace body sized to receive and support the patient's limb, one or more straps for holding the patient's limb against the brace body, and one or more fasteners for removably mounting the brace assembly to the tray of the third assembly.

8. The apparatus of claim 1, wherein the brace assembly comprises one or more of a hand support, a wrist support, a forearm support, a thigh support, a knee support, an ankle support, and a foot support removably mounted to the third assembly.

9. The apparatus of claim 1, wherein the base assembly comprises a telescoping base for adjusting a vertical height of the first, second, and third assemblies.

10. The apparatus of claim 1, further comprising at least one resilient band connected between the first assembly and the second assembly for resisting movement of the second assembly as it slides along the track of the first assembly, wherein the at least one resilient band has a force ranging from about 10 lbs. to about 75 lbs.

11. The apparatus of claim 10, wherein the at least one resilient band biases the second assembly to a natural position substantially in a center of the track of the first assembly.

12. The apparatus of claim 1, further comprising a motion wand pivotally mounted to a distal end of the third assembly, the motion wand being configured to be grasped by a user or by the patient to pull or push the second assembly along the track of the first assembly to control a range of motion of exercises performed using the apparatus.

13. A system for exercising one or more target joints comprising:

a stabilizing and strengthening apparatus comprising:

a height-adjustable elongated base defining a vertical axis;

a first assembly comprising a track mounted to a portion of the base, the track defining a movement pattern for at least one target joint of a patient;

a second assembly slidably mounted to the track of the first assembly to permit movement of the second assembly relative to the first assembly according to the movement pattern along the track to move the at least one target joint towards flexion or towards extension, wherein the second assembly slides along the track towards or away from the vertical axis defined by the elongated base;

a third assembly comprising a tray sized to receive a portion of a limb and/or joint of the patient, the third assembly being rotatably mounted to the second assembly at a pivot point to permit relative in-plane rotational motion of the third assembly relative to the second assembly about the pivot point for internal and external rotation of the at least one target joint; and a brace assembly fixedly mounted to the tray of the third assembly configured to receive portions of the joint and/or limb of the patient, thereby securing the joint and/or limb of the patient to the third assembly so that the at least one target joint can be exercised by movement of the first, second, and third assemblies relative to one another;

at least one force or velocity sensor disposed on the track of the first assembly for measuring a speed or force of the second assembly as the second assembly slides along the track; and a controller configured to:

receive and process information from the at least one force or velocity sensor;

analyze the processed information to determine one or more exercise parameters, the parameters comprising one or more of a quality, duration, and intensity of exercises performed with the apparatus; and generate a report including the one or more exercise parameters.

14. The system of claim 13, further comprising transmitting the report to a remote device for review by a physician, physical therapist, or caregiver.

15. The system of claim 13, wherein the controller is further configured to compare the one or more exercise parameters to one or more threshold values and to provide a notification to the patient when the parameters exceed the threshold values, wherein the threshold values are based on a treatment protocol for the patient.

16. The system of claim 13, further comprising the at least one position sensor disposed in the track of the first assembly for measuring a distance traveled by the second assembly along the track.

17. The system of claim 13, further comprising at least one pressure sensor disposed on a portion of the third assembly and/or on a portion of the brace assembly, the at least one pressure sensor being configured to be contacted by a limb of the patient and to measure a pressure exerted against the apparatus by the patient.

18. A method for treating a hip and knee of a patient with a multi-use stabilizing and strengthening apparatus, the method comprising:

stabilizing the patient's thigh and knee by attaching a knee brace to the patient's leg;

with the patient in a kneeling position and with the patient's knee resting on a portion of the apparatus, mounting the knee brace to the multi-use stabilizing and strengthening apparatus, wherein the apparatus comprises:

a height adjustable elongated base defining a vertical axis;

a first assembly comprising a track mounted to a portion of the base, the track defining a movement pattern for the hip and knee of the patient;

a second assembly slidably mounted to the track of the first assembly to permit motion of the second assembly relative to the first assembly according to the movement pattern along the track to move the hip or the knee towards flexion or towards extension, wherein the second assembly slides along the track towards or away from the vertical axis defined by the elongated base;

a third assembly comprising a tray sized to receive the patient's knee and lower leg, the third assembly being rotatably mounted to the second assembly at a pivot point to permit relative in-plane rotational motion of the third assembly relative to the second assembly about the pivot point for internal and external rotation of the hip or knee of the patient; and a brace assembly fixedly mounted to the tray of the third assembly to receive the knee brace for removably connecting the knee brace to the apparatus so that the hip and knee can be exercised by movement of the first, second, and third assemblies relative to one another;

moving the second assembly back and forth along the track to cause the flexion and extension of the hip or the knee; and rotating the third assembly back and forth relative to the second assembly about the pivot point to cause internal rotation and external rotation of the knee.

19. The method of claim 18, wherein movement of the respective assemblies occurs simultaneously, and wherein movement of the respective assemblies is active movement caused by extension and flexion, rotation, abduction and/or adduction of the patient's hip and/or knee.

20. The apparatus of claim 6, wherein the brace assembly comprises at least one of a wrist brace, a hip brace, or a foot/ankle brace, connected to the tray through the slot positioned at the distal end of the tray.

* * * * *